US010613475B2

(12) United States Patent
Nagashima et al.

(10) Patent No.: US 10,613,475 B2
(45) Date of Patent: Apr. 7, 2020

(54) PACKING MEMBER FOR LIQUID CONTAINER

(71) Applicant: SEIKO EPSON CORPORATION, Tokyo (JP)

(72) Inventors: Takumi Nagashima, Matsumoto (JP); Hiroyuki Kawate, Hokuto (JP); Hiroyoshi Ozeki, Shiojiri (JP); Manabu Yamaguchi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/224,165

(22) Filed: Dec. 18, 2018

(65) Prior Publication Data

US 2019/0196393 A1 Jun. 27, 2019

(30) Foreign Application Priority Data

Dec. 25, 2017 (JP) ..... 2017-248046

(51) Int. Cl.
*B41J 2/175* (2006.01)
*G03G 21/18* (2006.01)
*G03G 15/08* (2006.01)

(52) U.S. Cl.
CPC ..... *G03G 21/181* (2013.01); *G03G 15/0874* (2013.01)

(58) Field of Classification Search
CPC ..... B41J 2/175; G03G 21/181
See application file for complete search history.

(56) References Cited

U.S. PATENT DOCUMENTS

| | | | | |
|---|---|---|---|---|
| 7,455,396 | B2 * | 11/2008 | Wakayama | B41J 2/17513 222/386.5 |
| 8,136,932 | B2 * | 3/2012 | Nozawa | B41J 2/17509 347/84 |
| 9,346,278 | B2 | 5/2016 | Ishizawa et al. | |
| 10,343,412 | B2 * | 7/2019 | Kawate | B41J 2/17556 |
| 2018/0104955 | A1 | 4/2018 | Kawate et al. | |

FOREIGN PATENT DOCUMENTS

| | | |
|---|---|---|
| JP | 2007-083497 A | 4/2007 |
| JP | 2015-214040 A | 12/2015 |
| JP | 2018-065373 A | 4/2018 |

OTHER PUBLICATIONS

Google translation of JP 2015-168247, published on Sep. 2015 (Year: 2015).*

* cited by examiner

*Primary Examiner* — Huan H Tran
(74) *Attorney, Agent, or Firm* — Foley & Lardner LLP

(57) ABSTRACT

A packing member includes a first section arranged to face a first face of a flexible bag of the liquid container along a DW plane that includes the D direction and the W direction; a second section arranged to face a second face of the bag along the DW plane, and sandwiches the bag in the T direction in cooperation with the first section; a fixing portion that fixes the first section and the second section in a state of sandwiching the bag in the T direction; and a pressurizing portion that presses the region of a portion of the bag sandwiched between the first section and the second section in a fixed state where the bag is fixed between the first section and the second section by the fixing portion, such that pressure in the liquid storage portion rises.

20 Claims, 13 Drawing Sheets

PACKING MEMBER FOR LIQUID CONTAINER

CROSS REFERENCE TO RELATED APPLICATIONS

This application claims priority to Japanese Application No. 2017-248046 filed on Dec. 25, 2017. The entire disclosure of this Japanese application is expressly incorporated by reference herein.

BACKGROUND

1. Technical Field

The present invention relates to a packing member for a liquid container.

2. Related Art

As a liquid container, liquid containers that have a flexible bag in which liquid is contained, and supply liquid in the bag to a liquid ejection apparatus in a state of being mounted in the liquid ejection apparatus are known (e.g., JP-A-2015-214040 and JP-A-2007-83497 below, and the like). Such liquid containers are commonly packed in packing members when transported at the time of factory shipment, and when stored in an unused state.

Such a packing member for liquid container is usually configured to have a shape that corresponds to the outer shape of the bag in a state where liquid is contained, such that an excessive load is not applied to the bag of the liquid container due to the packing member. In JP-A-2015-214040 and JP-A-2007-83497 below, the liquid container is packed in a tray-like member formed to have a recessed portion configured in accordance with the outer shape of the liquid container (FIGS. 11 and 13 in JP-A-2015-214040, FIGS. 1 to 3 of JP-A-2007-83497, and the like).

JP-A-2015-214040 and JP-A-2007-83497 are examples of related art.

However, the inventor of the present invention has found that, even if the liquid container is packed in a packing member formed in accordance with the outer shape of the liquid container, when the liquid container is carried, the bag may repeatedly deform due to movement of liquid in the bag that vibrates and ripples, and deteriorate. The inventor also found that, if a structure is contained in the bag along with liquid, the bag and the structure itself may be damaged and deteriorated due to movement of the structure as a result of the liquid rippling.

Additionally, heretofore, a problem has been pointed out that, if the packing member is shaped in accordance with the outer shapes of the liquid container, in the case where the shape of the liquid container is changed based on change in the design of the liquid container or the like, the shape of the packing member is also required to be changed, which increases the manufacturing cost. A problem has also been pointed out in that, if the volume of the bag is increased in order to increase the liquid capacity of the liquid container, the size of the packing member increases accordingly.

As described above, in a packing technique for packing a liquid container, there has been room for improvement in improving the protection property for an object to be packed in a packing member and simplifying the configuration of the packing member, as used to be, such that damage and deterioration of the liquid container, which is an object to be packed, is further suppressed.

SUMMARY

The present invention has been made in order to solve at least a portion of the above-described issue, and can be achieved as the following aspects.

[1] A first aspect is provided as a packing member for packing a liquid container. Three directions orthogonal to each other are defined as a T direction, a D direction, and a W direction. The liquid container may include a flexible bag having a first face and a second face arranged to sandwich a liquid storage portion in the T direction, and a liquid output port provided on one edge of the bag and having a central axis that runs along the D direction. The packing member of this aspect includes a first section arranged to face the first face along a DW plane that includes the D direction and the W direction; a second section arranged to face the second face along the DW plane, and sandwiches the bag in the T direction in cooperation with the first section; a fixing portion that fixes the first section and the second section in a state of sandwiching the bag in the T direction; and a pressurizing portion that presses a region of a portion of the bag sandwiched between the first section and the second section such that, in a fixed state where the bag is fixed between the first section and the second section by the fixing portion, pressure in the liquid storage portion becomes higher than pressure before the fixed state is entered.

According to the packing member of this aspect, the liquid container is packed in a state where pressure of liquid in the bag is raised and the bag is tense, and thus change in the shape of the bag due to rippling of the liquid in the bag is suppressed. Thus, damage and deterioration of the liquid container due to rippling of the liquid in the liquid container is suppressed. In addition, even if the packing member is not configured to be shaped like the outer shape of the liquid container, protection that suppresses deterioration of the liquid container as described above is possible by providing the pressurizing portion. Thus, it is possible to simplify the configuration of the packing member.

[2] In the packing member of the above aspect, when, from among directions along the D direction, a direction from the liquid output port toward the liquid storage portion is defined as a +D direction, and a direction opposite to the +D direction is defined as a −D direction; the pressurizing portion may press the bag, in the fixed state, in a region positioned on the +D direction side relative to a center in the D direction of the liquid storage portion.

According to the packing member of this aspect, the pressurizing portion presses a region separated from the liquid output port, and thus deterioration of the liquid supply port due to being pressed by the pressurizing portion is suppressed. In addition, as a result of pressurizing by the pressurizing portion in the fixed state, liquid is kept from being pressed outward in a direction departing from the liquid supply port, and existing unevenly in a deep region of the bag. Therefore, when removing the liquid container from the packing member, liquid container is kept from coming into a state where liquid exists unevenly in such a region.

[3] In the packing member of the above aspect, in the fixed state, the pressurizing portion may be configured to press an entire region in the W direction of the bag, in a region on the +D direction side relative to a center in the D direction of the liquid storage portion.

According to the packing member of this aspect, in the fixed state, the bag is pressed in its entire region in the W direction corresponding to the width direction of the bag, and thus change in the orientation of the liquid container when packed in the packing member is suppressed, and deterioration of the liquid container is suppressed.

[4] In the packing member of the above aspect, when one of directions along the W direction is defined as a +W direction, and the other direction is defined as a −W direction; in the fixed state, the pressurizing portion may be configured press an entire region in the D direction of the bag, in a region on the +W direction side relative to a center in the W direction in the liquid storage portion, and a region on the −W direction side relative to the center in the W direction of the liquid storage portion.

According to the packing member of this aspect, in a fixed state, the bag is pressed both on the +W direction side and the −W direction side, and thus change in the orientation of the liquid container when packed in the packing member is further suppressed.

[5] In the packing member of the above aspect, the liquid container may further include a liquid outlet member that has the liquid output port, extends along the D direction in the liquid storage portion, and guides the liquid that is led out from the liquid output port, and, in the fixed state, the pressurizing portion may press the bag in a region positioned on the +D direction side relative to the liquid outlet member.

According to the packing member of this aspect, deterioration of the liquid outlet member due to being pressed by the pressurizing portion is suppressed.

[6] In the packing member of the above aspect, the pressurizing portion may further press the bag in regions positioned on two sides of the liquid outlet member in the W direction, in the fixed state.

According to the packing member of this aspect, it is possible to more tightly fix the liquid container to the packing member while suppressing deterioration of the liquid outlet member due to being pressed by the pressurizing portion.

[7] In the packing member of the above aspect, the liquid outlet member may include a spacer member that is provided in an end portion on the +D direction side, whose dimension in the T direction is largest in the liquid outlet member, and that suppresses collapse in the T direction of the liquid storage portion; and the pressurizing portion may press the bag such that, in the fixed state, a height in the T direction of the liquid storage portion at a position at which the spacer member is arranged is larger than a dimension in the T direction of the spacer member due to pressure of the liquid.

According to the packing member of this aspect, the bag is kept from receiving a load from the spacer member when packed in the packing member, and thus deterioration of the liquid container when packed in the packing member is suppressed.

[8] The packing member of the above aspect may be configured such that, in the fixed state, the spacer member floats in the liquid in the liquid storage portion, and is arranged in a state of being separated from an inner face of the bag.

According to the packing member of this aspect, when packed in the packing member, the bag is further kept from receiving a load from the spacer member.

[9] In the packing member of the above aspect, the first section and the second section may have flat-plate-like outer shapes; and the pressurizing portion may be constituted by a face that is provided in at least one of the first section and the second section, and protrudes on the bag side relative to another section in the fixed state.

According to the packing member of this aspect, the configuration thereof can be simplified.

[10] A second aspect is provided as a packing member for packing a liquid container. Three directions orthogonal to each other are defined as a T direction, a D direction, and a W direction. The liquid container may include a flexible bag having a first face and a second face arranged to sandwich a liquid storage portion in the T direction; and a liquid outlet member having a liquid output port provided on one edge of the bag and extending along the D direction in the liquid storage portion. The packing member of this aspect includes a first section that is arranged to face the first face along a DW plane that includes the D direction and the W direction; a second section arranged to face the second face along the DW plane, and sandwiches the bag in the T direction in cooperation with the first section; a fixing portion that fixes the first section and the second section in a state of sandwiching the bag in the T direction; and a pressing portion that presses at least a portion of the liquid outlet member via the bag in the T direction in a fixed state where the bag is fixed between the first section and the second section by the fixing portion, and suppresses movement of the liquid outlet member in the liquid storage portion.

According to the packing member of this aspect, movement of the liquid outlet member in the bag due to ripping of liquid in the bag in the packed liquid container is suppressed. Therefore, in a state where the liquid container is packed, damage and deterioration of the liquid outlet member is suppressed. In addition, even if the packing member configured to be shaped like the shape of the liquid container, the protection property of the liquid container is improved as described above by providing the pressing portion. Thus, it is possible to simplify the configuration of the packing member.

[11] A third aspect is provided as a package. The package in this aspect is a combination which includes one of the above mentioned liquid container and the packing member of one of the above aspects that packs the liquid container.

According to the package of this aspect, damage and deterioration of the liquid container due to rippling of liquid in the bag is suppressed. Thus, for example, durability against a load that is applied during transportation, conveyance, and the like is improved.

Not all of a plurality of constituent elements of the aspects of the present invention that have been described above are necessary, and in order to solve a part of, or the entire foregoing problem, or to achieve some or all of the effects described in the present specification, some of the constituent elements can be changed, deleted, or replaced with another new constituent element, and a portion of limiting contents can be deleted, as appropriate. In addition, in order to solve a part of, or the entire foregoing problem, or in order to achieve some or all of the effects described in the present specification, some or all of technical features included in one aspect of the present invention descried above can be combined with some or all of technical features included in another aspect of the present invention described above to form one independent aspect of the present invention.

The invention can be realized in various modes besides a packing member for a liquid container and a package. For example, the invention can be realized is modes such as a method for packing a liquid container, a packing structure of a liquid container, an apparatus that packs a liquid container using a packing member, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

1. First Embodiment

Introduction

Figure 1:
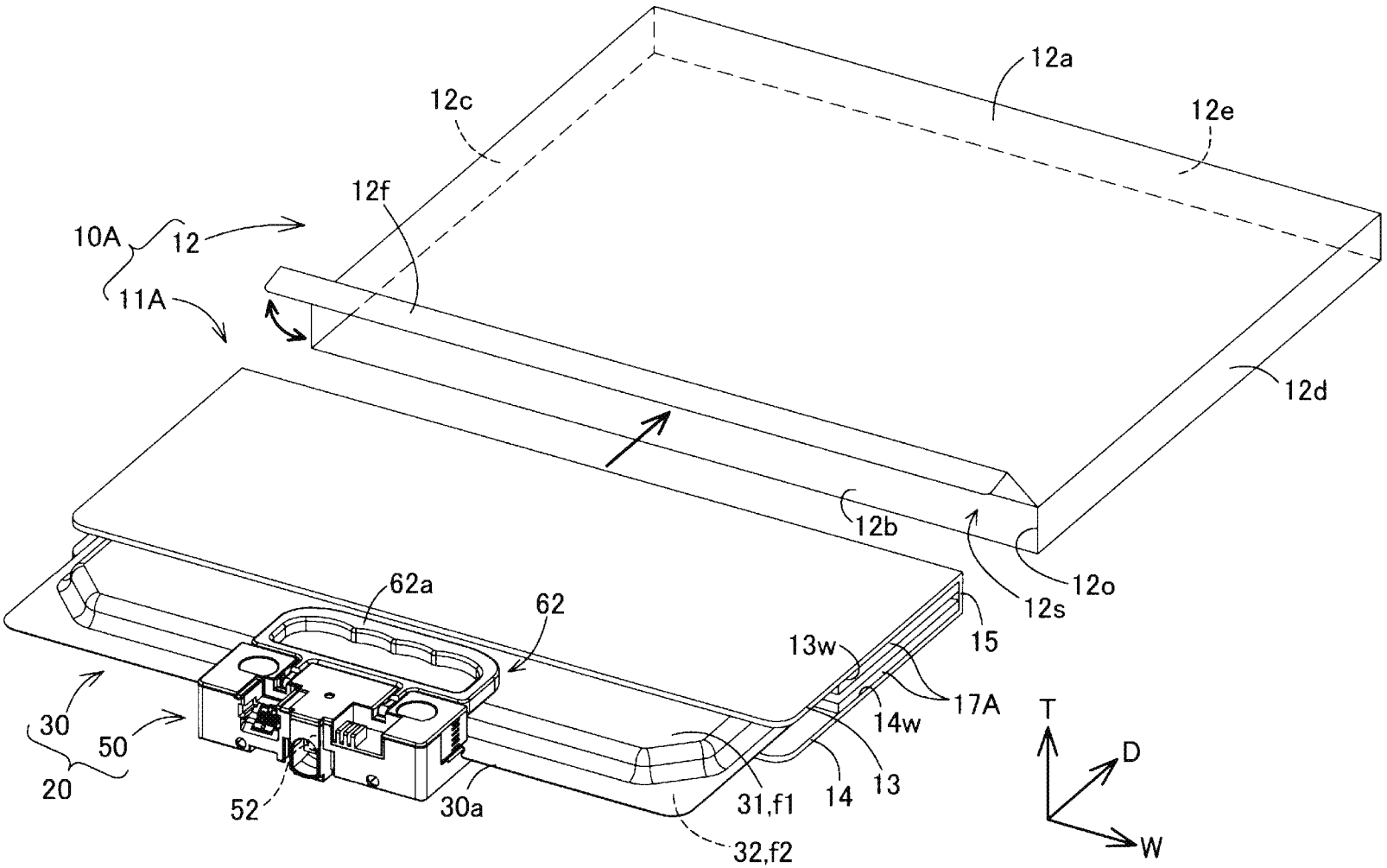
FIG. 1 is a first schematic perspective view showing the configuration of a packing member in a first embodiment.
Figure 2:
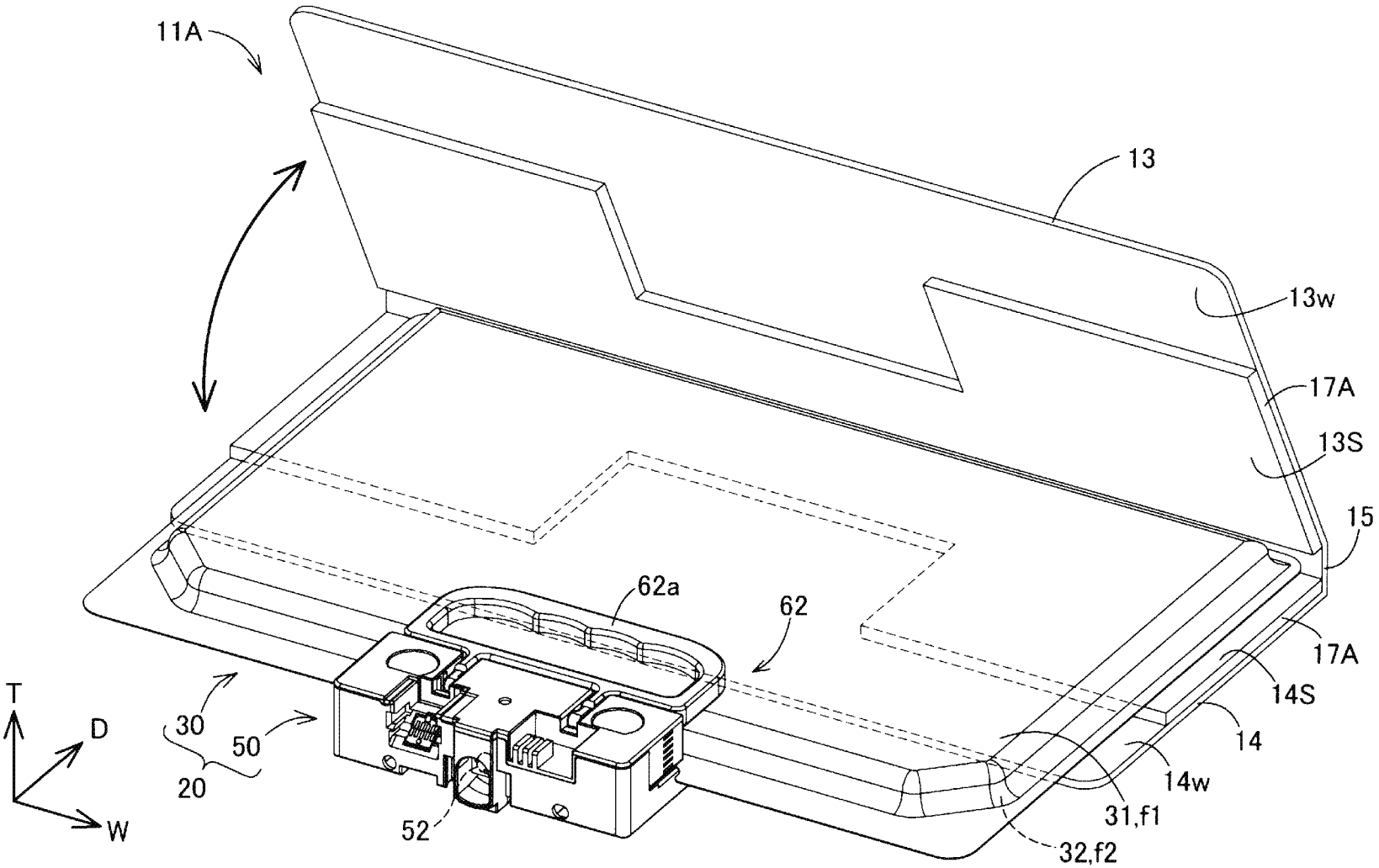
FIG. 2 is a second schematic perspective view showing the configuration of the packing member in the first embodiment.

FIGS. 1 and 2 are schematic perspective views showing the configuration of a packing member 10A in a first embodiment. The packing member 10A includes a holding member 11A, and a fixing portion 12. FIG. 1 illustrates a state where the holding member 11A that holds a liquid container 20 is removed from the fixing portion 12 that is constituted by an outer box. FIG. 2 illustrates a state where the holding member 11A of the packing member 10A is open.

The packing member 10A is used for packing the liquid container 20. The liquid container 20 contains liquid to be supplied to a liquid ejection apparatus (not illustrated). In the first embodiment, the liquid ejection apparatus is an inkjet printer that performs recording (printing) by ejecting ink, which is an example of a liquid, onto a medium such as paper. The liquid container 20 is packed in and protected by the packing member 10A in a state where a prescribed amount of liquid is encapsulated, for example, at the time of factory shipment, distribution in a market, or the like. The configuration of the liquid container 20 that is packed in the packing member 10A will be described below, and the configuration of the packing member 10A and packing of the liquid container 20 in the packing member 10A will be then described.

Configuration of Liquid Container

Figure 3:
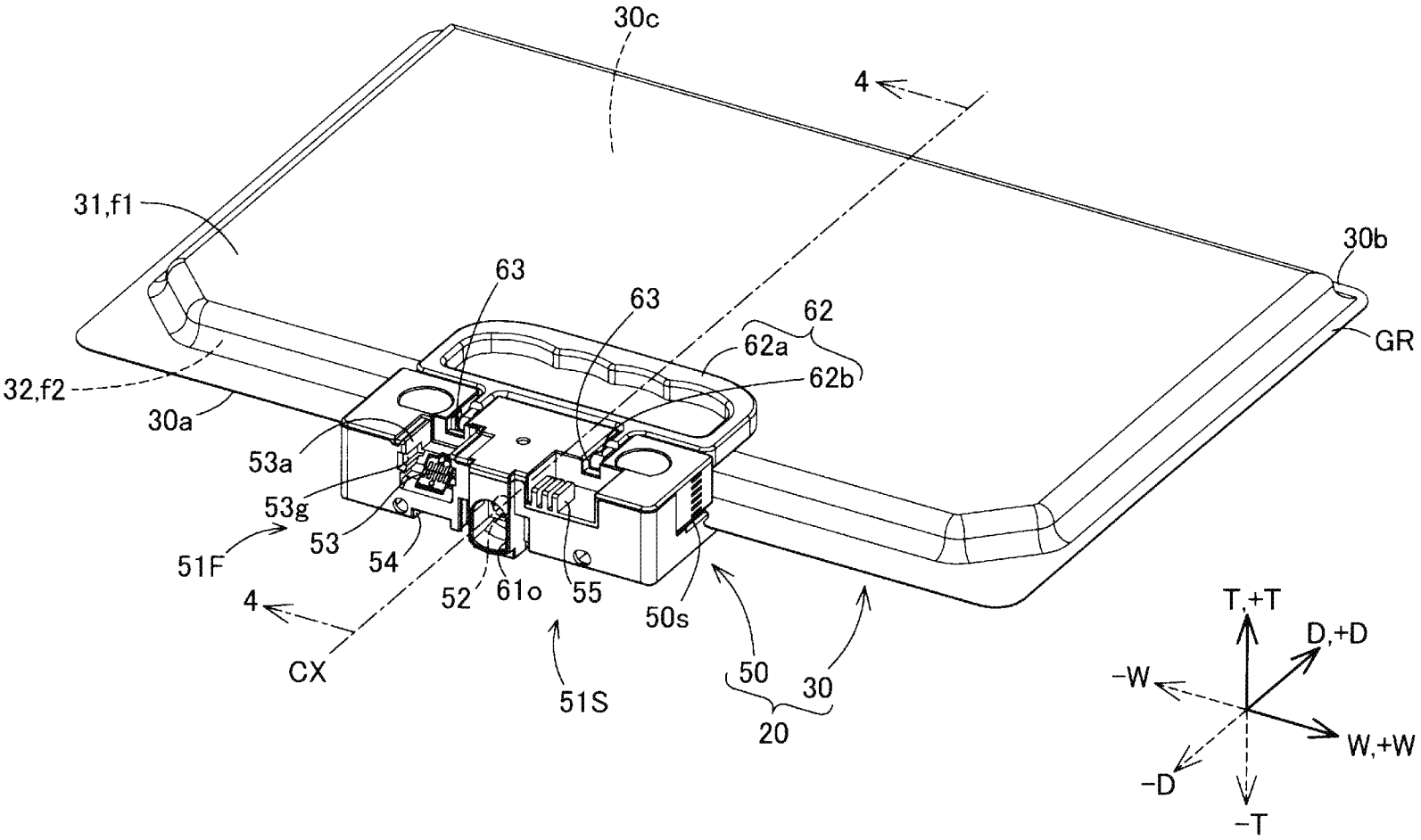
FIG. 3 is a schematic perspective view showing a liquid container in a reference arrangement orientation.

FIG. 3 is a schematic perspective view showing the liquid container 20. FIG. 3 shows arrows indicating three directions orthogonal to each other, namely a T direction, a D direction, and a W direction. Correspondence between the liquid container 20 and the T direction, the D direction, and the W direction will be described sequentially. In the following description, from among directions along the D direction, the T direction, and the W direction, positive directions indicated by the arrows of the D direction, the T direction, and the W direction are also referred to as a +D direction, a +T direction, and a +W direction, respectively. In addition, opposite directions (negative directions) of the D direction, the T direction, and the W direction to are also referred to as a −D direction, a −T direction, and a −W direction, respectively. The arrows indicating the T direction, the D direction, and the W direction are illustrated as appropriate in correspondence to those in FIG. 3, also in figures to be referred to later as well as FIGS. 1 and 2 that have been referred to already. Note that, in figures other than FIG. 3, arrows indicating the −T direction, the −D direction, and the −W direction are not illustrated.

The liquid container 20 contains liquid containing sedimentary components, and supplies liquid to the liquid ejection apparatus in a state of being mounted in the liquid ejection apparatus. "Sedimentary component" refers to a component that sinks in liquid due to gravity when the liquid is left to stand for a long time (e.g., a few hours or more). In the first embodiment, a sedimentary component is a pigment dispersed in a solvent. Note that, in another embodiment, liquid contained in the liquid container 20 is not required to contain sedimentary components.

The liquid container 20 includes a flexible bag 30 in which liquid is contained, and an adapter 50 provided with a connection structure to the liquid ejection apparatus. The inner space of the bag 30 constitutes a liquid storage portion 30*c* that is an inner space in which liquid is contained. The bag 30 has a first face 31 and a second face 32 that are arranged to sandwich the liquid storage portion 30*c* in the T direction. The first face 31 is a face that faces the +T direction, and is positioned on the +T direction side. The second face 32 is a face that faces the −T direction, and is positioned on the −T direction side. In FIG. 3, the second face 32 is positioned on the rear side of the liquid container 20 and does not appear in the figure, and thus, for convenience, the reference numeral is added along with a leading line that is a broken line.

Note that, in the present specification, "face" refers to what can be perceived as a section that occupies a certain two-dimensional region, when viewed entirely. Therefore, "face" includes not only a face formed of a continuous flat face, but also a face in which groove, recessed portion, slit, protrusion, and projection are formed on its surface, a face that is entirely or partially curved, and a face that entirely or partially includes a curved section.

In the first embodiment, the bag 30 has a flat shape, and a dimension in the T direction thereof is smallest. In addition, the first face 31 and the second face 32 of the bag 30 each constitute a face with the largest area in the bag 30. The bag 30 has a substantially rectangular shape when viewed in the T direction. In the first embodiment, the short-side direction of the bag 30 is the D direction, and the long-side direction is the W direction. It can be interpreted that the T direction is the thickness direction of the liquid container 20, the D direction is the depth direction (length direction) of the liquid container 20, and the W direction is the width direction of the liquid container 20. Note that, hereinafter, a stable arrangement orientation in which the liquid container 20 is arranged on a horizontal plane with the second face 32 side being a lower face, and that is illustrated is referred to as "reference arrangement orientation".

The bag 30 may be configured as a pillow type bag, or may be configured as a gusset type bag. In the first embodiment, the bag 30 a pillow type bag that is formed by overlapping two rectangular films f1 and f2 in the T direction, and joining the peripheral edges of the films to each other, and in which a gusset portion GR is formed in the periphery of the liquid storage portion 30*c*. Note that the outer surface of the first film f1 constitutes the above-described first face 31, and the outer surface of the second film f2 constitutes the above-described second face 32.

It is desirable that the films f1 and f2 are each formed of a material that is flexible and has gas barrier properties. Examples of the material of the films f1 and f2 include polyethylene terephthalate (PET), nylon, polyethylene, and the like. In addition, the films f1 and f2 may be formed using a layered structure in which a plurality of films made of such materials are layered. In such a layered structure, for example, a configuration may be adopted in which the outer layer is made of PET or nylon that has excellent impact resistance, and the inner layer is made of polyethylene that has excellent ink resistance. Furthermore, a film including a layer acquired by vapor depositing aluminum or the like may be one constituent member of the layered structure.

Hereinafter, in the D direction, the edge on the −D direction side of the bag 30 is referred to as "one edge 30*a*", and the edge on the +D direction side is referred to as "the other edge 30*b*". In the D direction, a direction from the one edge 30*a* side toward the other edge 30*b* is the +D direction, and the direction opposite to the +D direction is the −D direction. The adapter 50 is attached to the one edge 30*a* of the bag 30. In the first embodiment, the adapter 50 is attached at the center in the W direction.

In the first embodiment, the adapter 50 has a substantially rectangular parallelepiped shape. The adapter 50 is attached to the bag 30 to have faces that respectively face the directions in the T direction, the D direction, and the W direction, with the W direction serving as a long-side direction. Hereinafter, a face of the adapter 50 facing upward in a reference arrangement orientation is referred to as "upper face", and a face facing downward is also referred to as "lower face". In addition, a face of the adapter 50 facing the −D direction is also referred to as "front face", and a face facing the +D direction is also referred to as "back face". The one edge 30*a* of the bag 30 is inserted into a slit 50*s* that extends over the entire region in the W direction in the rear face of the adapter 50, and is held.

The adapter 50 has a liquid output port 52 for leading liquid in the liquid storage portion 30*c* to the outside of the bag 30. In FIG. 3, the liquid output port 52 is positioned at a deep position from an opening 610 provided in the front face of the adapter 50, and thus the position of the liquid output port 52 is illustrated in a broken line. The liquid output port 52 has a central axis CX (illustrated in a dashed-dotted line) that passes through the center of the liquid output port 52, and runs along the D direction. The liquid output port 52 is connected to the liquid ejection apparatus, and functions as a supply port for supplying liquid to the liquid ejection apparatus. When the liquid container 20 is mounted to the liquid ejection apparatus, a shaft-shaped liquid introduction tube (not illustrated) for suctioning liquid in the liquid container 20, the liquid introduction tube being provided in the liquid ejection apparatus, is inserted into the liquid output port 52 via the opening 610 in the +D direction, and is connected. Hereinafter, the +D direction is also referred to as "mounding direction" of the liquid container 20.

Here, when the +T direction is set to be an upward direction, and the −T direction is set to be a downward direction, and viewed in the +D direction, one direction indicating the right direction from among the directions along the W direction is defined as the +W direction, and the other direction indicating the left direction is defined as the −W direction. The adapter 50 has a first connection structure 51F and a second connection structure 51S, respectively on two sides sandwiching the liquid output port 52 in the W direction. The first connection structure 51F is positioned on the −W direction side relative to the liquid output port 52, and the second connection structure 51S is positioned on the +W direction side relative to the liquid output port 52.

The first connection structure 51F is provided with a connection terminal 53. The connection terminal 53 is provided on the surface of a circuit substrate, for example. The circuit substrate includes a storage unit that stores various types of information related to the liquid container 20 (e.g., the type of liquid contained in the liquid container 20, and the storage amount). The connection terminal 53 is electrically connected to a terminal portion provided in the liquid ejection apparatus, and exchanges the above-mentioned information with a control unit that manages supply of liquid in the liquid ejection apparatus.

The connection terminal 53 is preferably provided at a position above the liquid output port 52, in a reference arrangement orientation. Accordingly, in a reference arrangement orientation, liquid from the liquid output port 52 is kept from dripping to the connection terminal 53.

The connection terminal 53 is preferably arranged to face obliquely upward in a recessed portion 53*a* that is open upward and in the mounding direction, in a reference arrangement orientation. Since the connection terminal 53 is arranged at a deep position in the recessed portion 53*a*, the connection terminal 53 is protected, and is kept from being polluted and damaged. In addition, since the connection terminal 53 is arranged to face obliquely upward, the terminal portion of the liquid ejection apparatus is easily brought into contact with the connection terminal 53.

The first connection structure 51F is provided with an engagement groove 54. The engagement groove 54 is provided to extend in the +D direction in the lower face of the adapter 50. The end portion on the −D direction side of the engagement groove 54 is open in the front face of the adapter 50. In the reference arrangement orientation, the engagement groove 54 is provided below the connection terminal 53. When the liquid container 20 is mounted to the liquid ejection apparatus, an arm (not illustrated) provided in the liquid ejection apparatus is inserted into and engaged with the engagement groove 54 in order to restrict movement of the liquid container 20.

The second connection structure 51S has an identification portion 55 for preventing erroneous insertion arranged vertically above the liquid output port 52, in a reference arrangement orientation. The identification portion 55 has a pattern of projections and recessions arranged in the W direction. When the liquid container 20 is mounted to the liquid ejection apparatus, the identification portion 55 are fitted to blocks that constitute a projection-and-recession pattern, and are provided in the liquid ejection apparatus in advance. Accordingly, a different type of the liquid container 20 is kept from being mounted to the liquid ejection apparatus.

A handle portion 62 made of a material different from that of the adapter 50 is attached to the adapter 50. The handle portion 62 has a grip portion 62*a* that is gripped by the user, and a shaft portion 62*b* provided in a base end portion that extends from the grip portion 62*a*. In a recessed portion that is recessed from the upper face of the adapter 50 in the −T direction, by inserting the shaft portion 62*b* into a shaft receiving portion 63 that is open in the W direction, the handle portion 62 is rotatably attached to the adapter 50 such that the grip portion 62*a* rotates in the D direction. The rotation axis of the handle portion 62 is constituted by the shaft portion 62*b* and the shaft receiving portion 63.

The handle portion 62 assumes a first orientation and a second orientation as a result of rotation of the grip portion 62*a*. The first orientation is an orientation in which the grip portion 62*a* is positioned above the first face 31 of the bag 30, and is positioned at a position that is lower than or equal to the rotation axis of the handle portion 62. The second orientation is an orientation in which the grip portion 62*a* is separated from the first face 31 of the bag 30, and is positioned at a position higher than the rotation axis of the handle portion 62. FIG. 3 illustrates a state where the handle portion 62 is the first orientation. When carrying the liquid container 20, the user can bring the handle portion 62 into the second orientation, and place his or her hand on the grip portion 62*a*.

Figure 4:
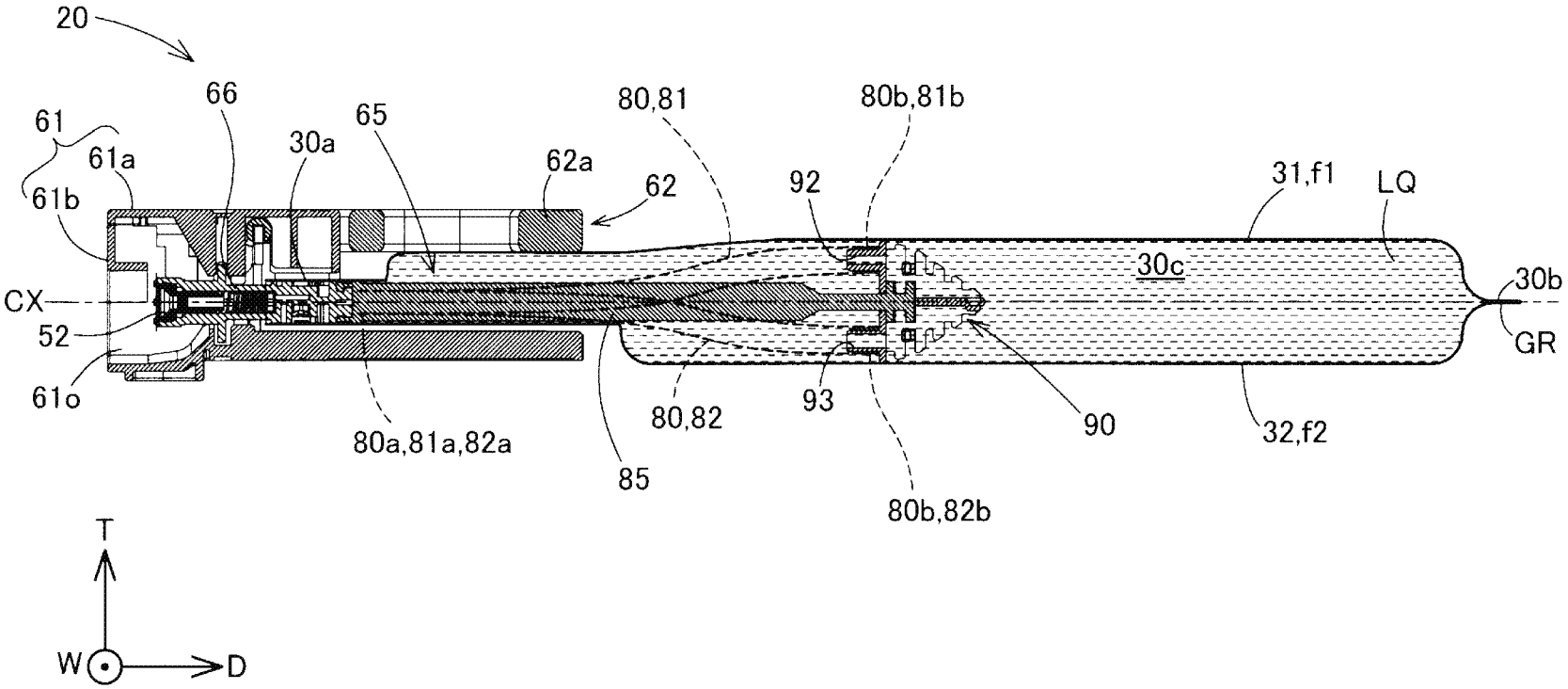
FIG. 4 is a schematic cross-sectional view of a liquid container.

FIG. 4 is a schematic cross-sectional view of the liquid container 20 cut along a line 4-4 (illustrated in FIG. 3) passing through the central axis CX of the liquid output port 52. FIG. 4 illustrates a state where a prescribed amount of liquid LQ is encapsulated in the liquid storage portion 30*c* at the time of factory shipment of the liquid container 20. "Prescribed amount at the time of factory shipment" is the amount of the liquid LQ contained in the liquid container 20 that has not been used. In the first embodiment, the liquid LQ is contained in the liquid container 20 at the time of factory shipment in a state where the liquid LQ spreads over the entire liquid storage portion 30*c* so as to not create a section in the liquid storage portion 30*c* in which the films f1 and f2 are in contact with each other. When the liquid container 20 at the time of factory shipment is in an unused state, it is desirable that the liquid storage portion 30*c* is in a state of not allowing gas to enter, and being filled with the liquid LQ.

The liquid container 20 is provided with a liquid outlet member 65. The liquid outlet member 65 has the liquid output port 52. The liquid outlet member 65 is arranged along the D direction in the liquid storage portion 30*c*. The liquid outlet member 65 guides the liquid LQ in the liquid storage portion 30*c* to the liquid output port 52. The liquid outlet member 65 has a leading end member 66, a liquid outlet tube 80, a coupling member 85, and a spacer member 90.

The leading end member 66 constitutes the end portion on the −D direction side of the liquid outlet member 65, and has the liquid output port 52, in the leading end portion on the −D direction side. The leading end member 66 is attached to the one edge 30*a* of the bag 30, in a state where a leading end portion including the liquid output port 52 is exposed from the one edge 30*a* of the bag 30. The liquid outlet tube 80 is connected to the end portion on the +D direction side of the leading end member 66 that is arranged in the liquid storage portion 30*c*. In the leading end member 66, a channel that brings the liquid output port 52 and the liquid outlet tube 80 into communication is formed (not illustrated).

In the liquid storage portion 30*c*, the liquid outlet tube 80 constitutes a flow tube path for guiding the liquid LQ to the leading end member 66. In FIG. 4, for convenience, the liquid outlet tube 80 is illustrated in a broken line. In the liquid storage portion 30*c*, the liquid outlet tube 80 extends from the leading end member 66 toward the other edge 30*b* of the bag 30. In the first embodiment, the liquid outlet tube 80 is arranged in the liquid storage portion 30*c* to extend in the horizontal direction, in the mounted orientation.

The liquid outlet tube 80 is constituted by an elastic tube formed of elastomer, for example. In the first embodiment, the liquid outlet tube 80 includes a first conduit portion 81 and a second conduit portion 82, and is constituted by two tubes (to be described in detail later). In another embodiment, the liquid container 20 may be provided with three or more liquid outlet tubes 80, or may be provided with only one liquid outlet tube 80.

A leading end portion 80*a* of the liquid outlet tube 80 is connected to the leading end member 66, in the liquid storage portion 30*c*. The leading end portion 80*a* includes a first leading end portion 81*a* of the first conduit portion 81 and a second leading end portion 82*a* of the second conduit portion 82. The liquid outlet tube 80 extends from the leading end member 66 toward the spacer member 90 arranged in the liquid storage portion 30*c*.

In the first embodiment, a base end portion 80*b* of the liquid outlet tube 80 is connected to the spacer member 90. The base end portion 80*b* includes a first base end portion 81*b* of the first conduit portion 81 and a second base end portion 82*b* of the second conduit portion 82. The liquid LQ in the liquid storage portion 30*c* is introduced into the liquid outlet tube 80 through a first introduction port 92 and a second introduction port 93 provided as through holes that pass through the spacer member 90 in the D direction. Note that, in another embodiment, the base end portion 80*b* of the liquid outlet tube 80 is not required to be connected to the spacer member 90. In this case, the first introduction port 92 and the second introduction port 93 of the spacer member 90 may be omitted.

The spacer member 90 is a structure for defining a region having a certain volume, in the liquid storage portion 30*c* in the bag 30. In the liquid outlet member 65, the dimension in the T direction of the spacer member 90 is largest, and the spacer member 90 suppresses collapse in the T direction of the liquid storage portion 30*c* when the liquid LQ in the liquid storage portion 30*c* is consumed and the liquid storage portion 30*c* shrinks. The spacer member 90 is made of synthetic resin such as polyethylene or polypropylene, for example.

The spacer member 90 has a portion positioned on the +D direction side relative to the liquid outlet tube 80. In the first embodiment, in the liquid storage portion 30*c*, the spacer member 90 is arranged at a position intersecting a TD plane that passes through the central axis CX of the liquid output port 52. The TD plane is a virtual plane including the T direction and the D direction, and is a virtual plane parallel to the T direction and the D direction. In the first embodiment, the spacer member 90 has a section arranged at the center in the D direction in the liquid storage portion 30*c*.

When the above-described liquid container 20 in which a prescribed amount of the liquid LQ is contained is brought into a reference arrangement orientation, at least one of the lowermost portion and the uppermost portion of the spacer member 90 comes into contact with inner faces of the bag 30. In the first embodiment, as shown in FIG. 4, both the lowermost portion and the uppermost portion of the spacer member 90 come into contact with inner faces of the bag 30.

In the liquid container 20, in a section in which the spacer member 90 is arranged, collapse in the T direction of the bag 30 is suppressed by the spacer member 90, and direct contact of inner faces opposing each other in the T direction of the bag 30 is suppressed. Therefore, even if the liquid LQ contained in the bag 30 is consumed, and the bag 30 shrinks, a space that liquid can enter is formed in the periphery of the spacer member 90. Thus, flow of the liquid LQ into the liquid outlet tube 80 through the first introduction port 92 and the second introduction port 93 of the spacer member 90 is kept from being inhibited due to collapse of the bag 30.

In the first embodiment, the spacer member 90 is fixed to the leading end member 66 by the bar-like coupling member 85. In a reference arrangement orientation, the coupling member 85 is arranged to extend along the central axis CX of the liquid output port 52 in the D direction. The end portion on the −D direction side of the coupling member 85 is coupled to the leading end member 66, and the end portion on the +D direction side is coupled to the spacer member 90. As a result of the spacer member 90 being fixed to the leading end member 66 via the coupling member 85, the positional relationship between the spacer member 90 and the leading end member 66 is stabilized. The coupling member 85 may be made of synthetic resin similar to the spacer member 90, or may also be made from another different material. In another embodiment, the coupling member 85 may be omitted.

Figure 5:
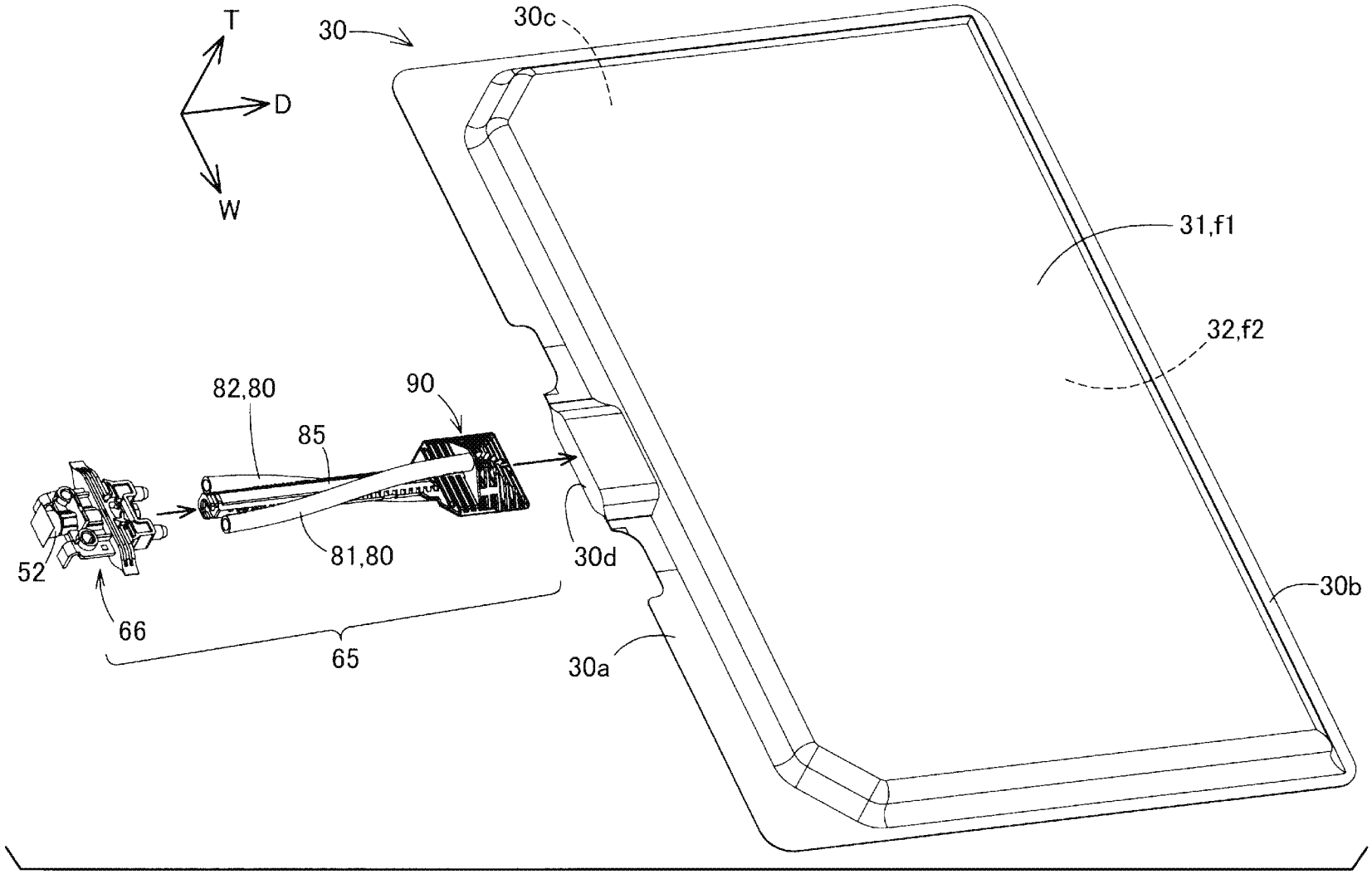
FIG. 5 is a schematic exploded perspective view showing a process for attaching a liquid outlet member to a bag.

FIG. 5 is a schematic exploded perspective view showing a process for attaching the liquid outlet member 65 to the bag 30. The liquid outlet member 65 is inserted into the liquid storage portion 30*c* through an opening portion 30*d* that has been provided on the one edge 30*a* side of the bag 30 in advance. In the first embodiment, the opening portion 30*d* is provided substantially at the center in the W direction of the bag 30. The liquid outlet member 65 is inserted to a predetermined position at which the liquid output port 52 of the leading end member 66 protrudes from the opening portion 30*d*. By welding an inner periphery face of the opening portion 30*d* of the bag 30 to an outer periphery face of the leading end member 66, the leading end member 66 is fixed to the bag 30. By welding the opening portion 30*d* to the leading end member 66, an opening leading to the outside other than channels in the leading end member 66 is sealed in the liquid storage portion 30*c*.

Figure 6:
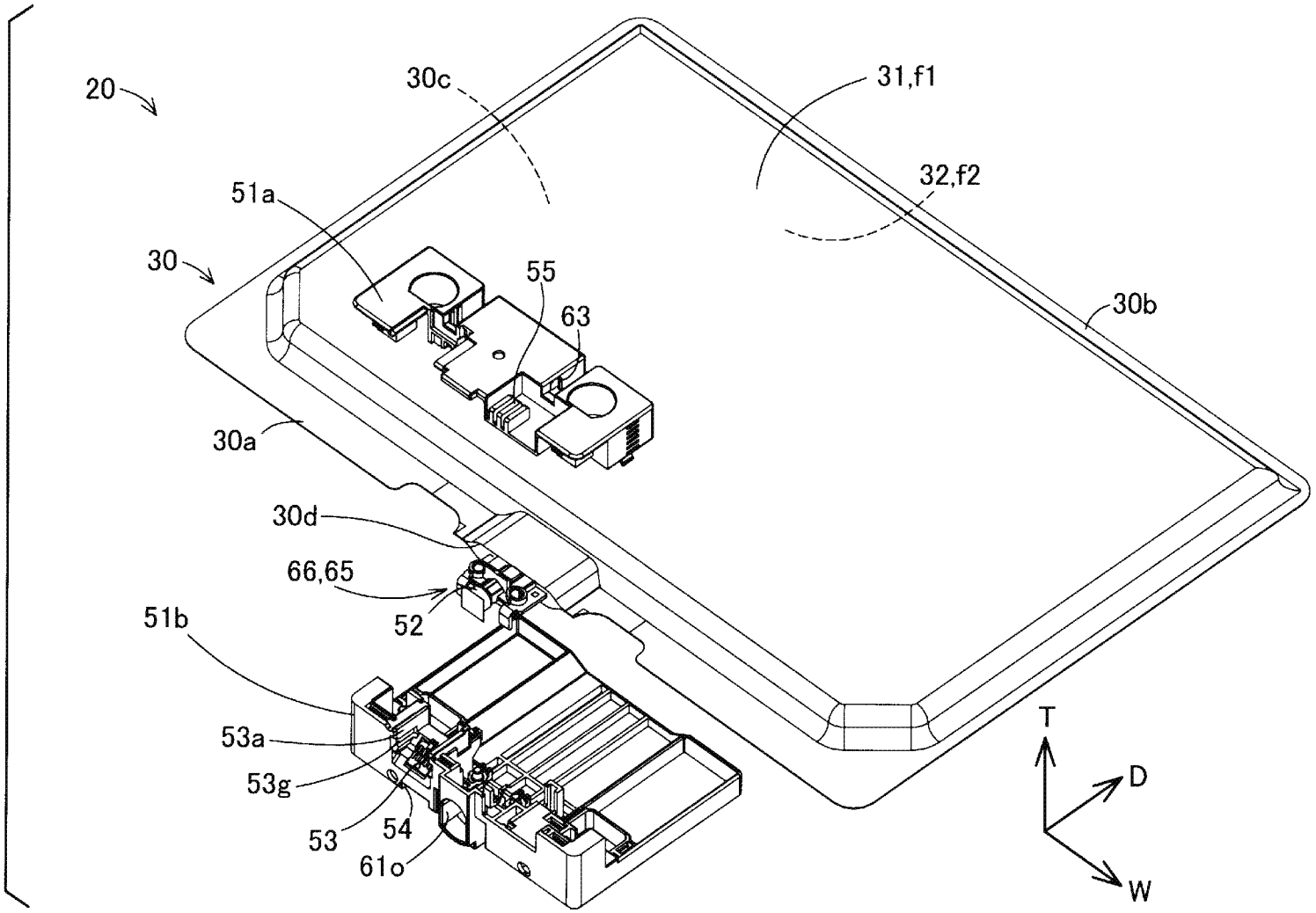
FIG. 6 is a schematic exploded perspective view showing a process for attaching an adapter to a bag.

FIG. 6 is a schematic exploded perspective view showing a process for attaching the adapter 50 to the bag 30. The adapter 50 is constituted by a lid member 51*a* and a bottom member 51*b* that can be separated in the T direction. As a result of the lid member 51*a* and the bottom member 51*b* sandwiching, from the +T direction side and the −T direction side, the one edge 30*a* of the bag 30 that includes the leading end member 66 protruding in the −D direction, the adapter 50 is fixed to the bag 30. A gap between the lid member 51*a* and the bottom member 51*b* constitutes the slit 50*s* described with reference to FIG. 3.

Configuration of Packing Member

A schematic configuration of the packing member 10A will be described with reference to FIGS. 1 and 2. The liquid container 20 is packed in the packing member 10A to be kept in a state where the holding member 11A holds the liquid container 20 by the fixing portion 12, as will be described below.

The holding member 11A holds at least the bag 30 out of the liquid container 20 by sandwiching the bag 30 in the T direction, such that the flexible bag 30 is supported in a posture extending along the D direction and the W direction (see FIG. 1). The holding member 11A has a first section 13, a second section 14, and a coupling portion 15.

The first section 13 is configured to be arranged to face the first face 31 of the bag 30 along the DW plane when the first section 13 and the second section 14 sandwich and hold the bag 30. In addition, the second section 14 is configured to be arranged to face the second face 32 of the bag 30 along the DW plane. Here, the DW plane refers to a virtual plane that includes the D direction and the W direction, and a virtual plane parallel to the D direction and the W direction.

It is desirable that the first section 13 and the second section 14 have flat-plate-like outer shapes. Accordingly, the configuration of the holding member 11A is simplified, the holding member 11A is manufactured easily, and the manufacturing cost is reduced. In addition, it is possible to reduce the thickness of the outer shape of the liquid container 20 after being packed in the packing member 10A, and to simplify the outer shape. In the first embodiment, the first section 13 and the second section 14 are constituted by plate-like members having substantially rectangular shapes.

In the first embodiment, the first section 13 and the second section 14 have substantially the same dimension. In addition, the dimensions in the long-side direction of the first section 13 and the second section 14 are larger than the dimension in the W direction of the bag 30 of the liquid container 20, and the first section 13 and the second section 14 are arranged to cover the bag 30 over the entire region in the W direction. Accordingly, it is possible to broadly protect the bag 30 over the region in the W direction, using the holding member 11A.

In the first embodiment, the dimensions in the short-side direction of the first section 13 and the second section 14 are smaller than the dimension in the D direction of the bag 30, and the first section 13 and the second section 14 are configured to sandwich the bag 30 in a state where a portion on the one edge 30*a* side of the bag 30 is exposed. The first section 13 and the second section 14 hold the bag 30 on the +D direction side relative to the adapter 50 of the liquid container 20. Accordingly, interference of the holding member 11A and the adapter 50 is suppressed, and it is made easy to arrange the first section 13 and the second section 14 in a posture extending along the DW plane.

It is desirable that the first section 13 and the second section 14 are configured to hold the bag 30 on the +D direction side relative to the grip portion 62*a* of the handle portion 62 in the first orientation. Accordingly, interference of the holding member 11A and the grip portion 62*a* is suppressed, and it is made easy to arrange the first section 13 and the second section 14 in an orientation closer to be parallel to the DW plane. In addition, even in a case where the liquid container 20 is held by the holding member 11A, the user can place his or her finger on the grip portion 62*a*. Therefore, handling of the liquid container 20 when the user releases a packed state of the liquid container 20 in the packing member 10A is made easy.

The first section 13 and the second section 14 are coupled by the coupling portion 15, in a state of being aligned in the short-side direction (see FIGS. 1 and 2). The coupling portion 15 couples long sides of the first section 13 and the second section 14. The first section 13 and the second section 14 rotate about the respective long sides coupled to the coupling portion 15 serving as rotation axes (see FIG. 2). The first section 13 and the second section 14 rotate from a state of being open as shown in FIG. 2, in a direction approaching each other, and close in a state of being overlapped each other in the thickness direction as shown in FIG. 1, so as to sandwich the bag 30.

Note that, a pressurizing portion 17A that presses a portion of the bag 30 in a fixed state, which will be described later, is provided in each of an inner wall face 13*w* in the first section 13 that face the first face 31 of the bag 30 and an inner wall face 14*w* in the second section 14 that faces the second face 32 of the bag 30 (see FIGS. 1 and 2). The configuration and function of the pressurizing portion 17A will be described later.

In the first embodiment, the coupling portion 15 is arranged along a TW plane to face the other edge 30*b* of the bag 30 in a state where the bag 30 is sandwiched by the first section 13 and the second section 14 (see FIGS. 1 and 2).

Here, the TW plane refers to a virtual plane that includes the T direction and the W direction, and a virtual plane that is parallel to the T direction and the W direction. Accordingly, in a state where the bag 30 is held by the holding member 11A, the other edge 30*b* of the bag 30 is protected by the coupling portion 15.

In the first embodiment, the coupling portion 15 is configured as a plate-like section having a substantially rectangular shape, and is configured to have a dimension in the long-side direction that is substantially the same as the dimensions in the long-side direction of the first section 13 and the second section 14. Accordingly, the other edge 30*b* of the bag 30 is covered over the entire region in the W direction, and thus the other edge 30*b* of the bag 30 is protected. Note that it is desirable that the dimension in the short-side direction of the coupling portion 15 is determined in accordance with the thickness in the T direction of the bag 30 that contains the above-described prescribed amount of liquid at the time of factory shipment, such that the first section 13 and the second section 14 easily sandwich the bag 30 in a state closer to being parallel to a DW plane.

It is desirable that the first section 13 and the second section 14 have enough rigidity to be able to support the bag 30 that contains the prescribed amount of liquid at the time of factory shipment, which has been described above, in a posture extending in the D direction. In the first embodiment, the holding member 11A is created from thick paper that is thick enough to realize such rigidity, for example. A cardboard is preferred as the thick paper that makes up the holding member 11A. A cardboard easily secures such rigidity, and makes it possible to reduce the weight, and suppress increase in the manufacturing cost.

In the first embodiment, the holding member 11A is created by folding, into two or three, thick paper that has been cut into a rectangular shape, such that the first section 13, the second section 14, and the coupling portion 15 are formed. This makes it possible to further suppress increase in the manufacturing cost of the packing member 10A. Note that, in another embodiment, the holding member 11A may be created from a material other than thick paper. The holding member 11A may be created from various resin members including foamed polystyrene, for example.

Description will be given with reference to FIG. 1. The fixing portion 12 fixes the first section 13 and the second section 14 in a state of sandwiching the bag 30 in the T direction. Hereinafter, a state where the bag 30 is fixed between the first section 13 and the second section 14 by the fixing portion 12 is also referred to as "fixed state". Note that, in a fixed state, the first section 13 is in a state of being arranged to face the first face 31 of the bag 30 in a posture extending along the DW plane, and the second section 14 is in a state of being arranged to face the second face 32 of the bag 30, in a posture extending along the DW plane.

In the first embodiment, the fixing portion 12 is configured by a hollow box having an outer shape of substantially rectangular parallelepiped shape. When the liquid container 20 in the state where the bag 30 is held by the holding member 11A is inserted into an inner space 12*s* of the fixing portion 12 from the other edge 30*b* side of the bag 30 in the +D direction, the liquid container 20 and the holding member 11A are fastened by the wall portions 12*a* to 12*d* of the fixing portion 12. Accordingly, the liquid container 20 and the holding member 11A are brought into the above-described fixed state, and a state where the liquid container 20 is packed in the packing member 10A is entered.

A detailed configuration of the fixing portion 12 will be described. In a fixed state, the fixing portion 12 has a first wall portion 12*a* facing the first section 13 of the holding member 11A and a second wall portion 12*b* facing the second section 14. It is desirable that the first wall portion 12*a* and the second wall portion 12*b* each have a dimension to cover the entire face extending along the DW plane of the liquid container 20 held by the holding member 11A. This makes it possible to protect the entire face extending along the DW plane of the liquid container 20.

The fixing portion 12 has a third wall portion 12*c* and a fourth wall portion 12*d* that are a pair of side wall portions intersecting the first wall portion 12*a* and the second wall portion 12*b*. In a fixed state, the third wall portion 12*c* is positioned on the −W direction side of the first wall portion 12*a* and the second wall portion 12*b*, and is arranged along a DT plane with the D direction serving as a long-side direction. In a fixed state, the fourth wall portion 12*d* is positioned on the +W direction side of the first wall portion 12*a* and the second wall portion 12*b*, and is arranged along the DT plane with the D direction serving as a long-side direction. Here, the DT plane is a virtual plane that includes the D direction and the T direction, and is a virtual plane extending along the D direction and the T direction. The edge portion on the +W direction side and the edge portion on the −W direction side of the liquid container 20 that is in a packed state are protected by the third wall portion 12*c* and the fourth wall portion 12*d*.

In the fixing portion 12, the distance between the first wall portion 12*a* and the second wall portion 12*b* is defined by the dimensions in the short-side direction of the third wall portion 12*c* and the fourth wall portion 12*d*. It is desirable that, in a fixed state, the dimensions in the short-side direction of the third wall portion 12*c* and the fourth wall portion 12*d* are determined to be the same as the dimension of the bag 30 including the first section 13 and the second section 14 of the holding member 11A, in the T direction, when being pressed from the first wall portion 12*a* and the second wall portion 12*b*. The dimensions in the short-side direction of the third wall portion 12*c* and the fourth wall portion 12*d* may be the same as the distance between the edge portions in the T direction of the holding member 11A in a fixed state, for example. Alternatively, the dimensions in the short-side direction of the third wall portion 12*c* and the fourth wall portion 12*d* may be smaller than the distance between the edge portions in the T direction of the holding member 11A in a fixed state.

The fixing portion 12 desirably has a fifth wall portion 12*e* that is a wall portion intersecting the first wall portion 12*a*, the second wall portion 12*b*, the third wall portion 12*c*, and the fourth wall portion 12*d*, and positioned in the +D direction side of the other edge 30*b* of the liquid container 20 in a packed state. Due to the fifth wall portion 12*e*, the liquid container 20 contained in the inner space 12*s* is kept from falling off from the fixing portion 12 toward the +D direction side.

The fixing portion 12 has an opening portion 12*o* for inserting the liquid container 20 surrounded by the first wall portion 12*a*, the second wall portion 12*b*, the third wall portion 12*c*, and the fourth wall portion 12*d*. It is desirable that the fixing portion 12 has a lid portion 12*f* configured to be able to block the opening portion 12*o* in a state where the liquid container 20 is contained in the inner space 12*s*. In this embodiment, the lid portion 12*f* is configured as a tongue-like section extending from the opening portion 12*o*. As a result of the lid portion 12*f* blocking the opening portion 12*o*, the liquid container 20 contained in the inner space 12*s* is kept from being damaged due to an extraneous material entering the fixing portion 12. In addition, the liquid container 20 contained in the inner space 12*s* is kept from falling off from the fixing portion 12 toward the −D direction side.

In the first embodiment, the fixing portion 12 is made of thick paper. The fixing portion 12 may be made of a cardboard. This makes it possible to reduce the weight of the fixing portion 12 while improving rigidity of the fixing portion 12, and it is also possible to reduce the manufacturing cost of the fixing portion 12. The material of the fixing portion 12 is not limited to thick paper, and the fixing portion 12 may be made of various materials. The fixing portion 12 may be made of a resin member, a metal member, a mood material, or the like.

Note that, it is desirable that the liquid container 20 in a state of being held by the holding member 11A is inserted, first from the coupling portion 15 of the holding member 11A, into the inner space 12*s* of the fixing portion 12 in the +D direction as described above. Before brought into a fixed state by the fixing portion 12, the distance between the first section 13 and the second section 14 in the T direction in a state where the first section 13 and the second section 14 sandwich the bag 30 is smaller toward the coupling portion 15 positioned on the +D direction side. Therefore, in a case of the above-described insertion direction, it is easy to insert the liquid container 20 into the inner space 12*s* of the fixing portion 12. In addition, it is easy for the user to access the handle portion 62 when removing the liquid container 20 from the fixing portion 12.

Figure 7:
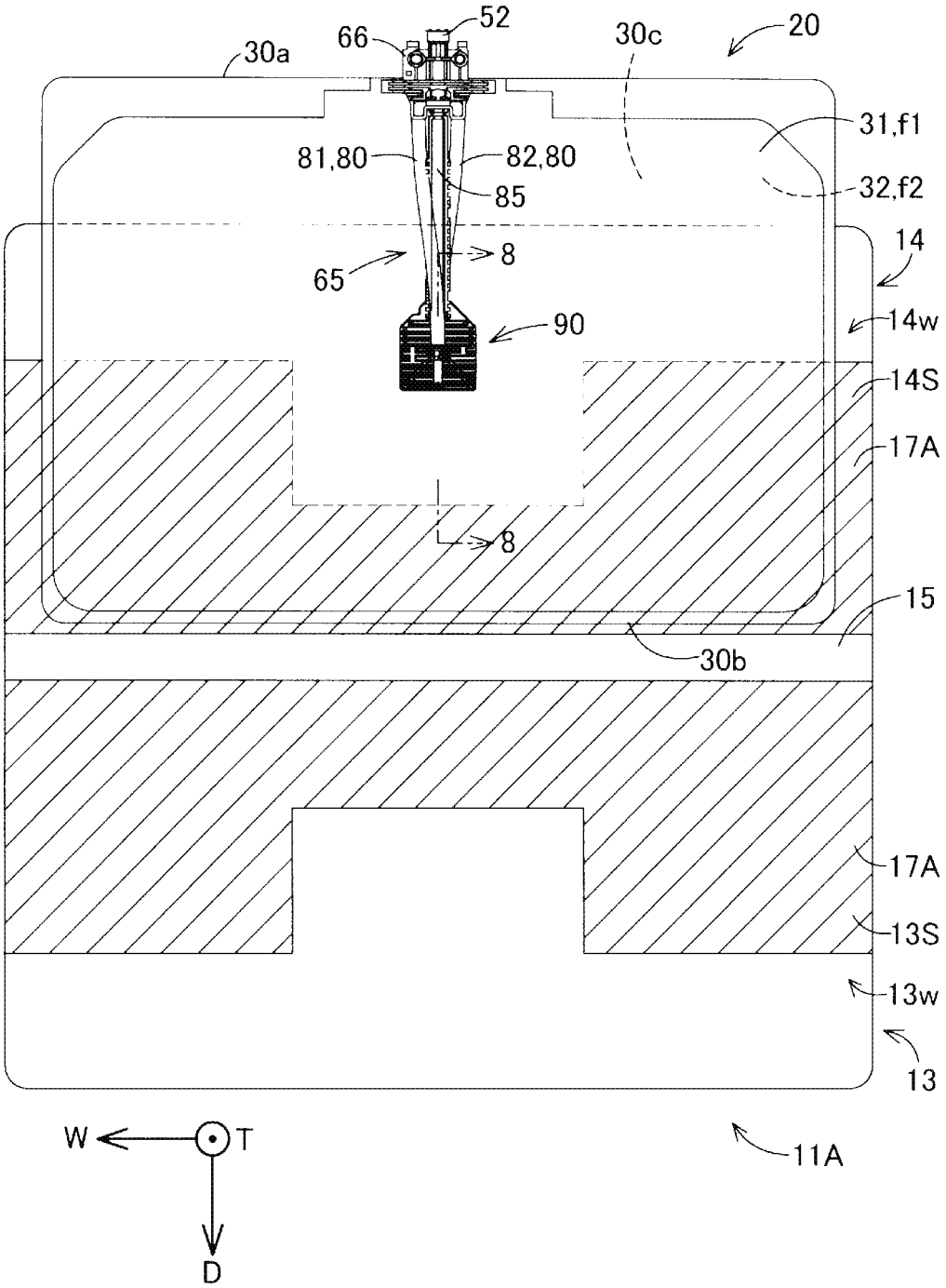
FIG. 7 is a schematic plan view showing the configuration of a pressurizing portion in the first embodiment.

The configuration of the pressurizing portion 17A provided in the holding member 11A will be described with additional reference to FIG. 7. FIG. 7 is a schematic plan view of the holding member 11A and the liquid container 20 when developed from a fixed state and viewed in the T direction. In FIG. 7, a region in which the pressurizing portion 17A is formed is hatched. In FIG. 7, for convenience, the adapter 50 is not illustrated. In addition, the liquid outlet member 65 is illustrated to be visible through the bag 30 so as to show the position at which the liquid outlet member 65 is arranged.

The pressurizing portions 17A of the first embodiment are respectively constituted by faces 13S and 14S protruding toward the bag 30 side further than other sections, in a fixed state, in the inner wall face 13*w* of the first section 13 and the inner wall face 14*w* of the second section 14 (see FIGS. 1 and 2). Hereinafter, the face 13S of the first section 13 is also referred to as "first protruding face 13S", and the face 14S of the second section 14 is also referred to as "second protruding face 14S". When the first section 13 and the second section 14 are arranged on a horizontal plane with the inner wall faces 13*w* and 14*w* side facing upward, the protruding faces 13S and 14S are configured as faces positioned at positions higher than other sections in the inner wall face 13*w* and the inner wall face 14*w*. The pressurizing portions 17A may be constituted by flat members layered on the inner wall faces 13*w* and 14*w* sides of the first section 13 and the second section 14, for example.

When the bag 30 is sandwiched by the first section 13 and the second section 14 of the holding member 11A, the partial regions of the bag 30 that face the pressurizing portions 17A of the holding member 11A receive, in the T direction, pressing force larger than in other sections sandwiched by the holding member 11A (see FIG. 1). Accordingly, liquid in the bag 30 is pressed from regions that receive pressing force from the pressurizing portion 17A, to the outside of the regions.

The pressurizing portions 17A are configured to press the regions of portions of the bag 30, in a fixed state where the bag 30 is fixed between the first section 13 and the second section 14 by the fixing portion 12, such that the pressure in the liquid storage portion 30*c* becomes higher than the pressure before the fixed state is entered. Therefore, when the liquid container 20 is packed in the packing member 10A, a section in the bag 30 that is not pressurized by the pressurizing portion 17A is inflated more than before the fixed state is entered, and tension of the films f1 and f2 increases, and the films f1 and f2 become tense.

As described above, if the liquid container 20 is packed in a state where the pressure in the liquid storage portion 30*c* has risen and the bag 30 is tense, movement of liquid in the bag 30 that vibrates and ripples when the liquid container 20 is carried is suppressed. Thus, deterioration of the bag 30 as a result of repeated deformation and application of a load to a welding portion in the gusset portion GR and the like of the bag 30 due to such rippling of liquid in the liquid storage portion 30*c* are suppressed. In addition, movement of the liquid outlet member 65 in the bag 30 and damage and deterioration of the liquid outlet member 65 itself due to rippling of liquid, are suppressed, and damage of inner faces of the bag 30 and deterioration of the bag 30 due to movement of the liquid outlet member 65 are also suppressed.

In the first embodiment, the protruding faces 13S and 14S that respectively constitute the pressurizing portions 17A are provided in corresponding formation regions in the inner wall face 13*w* of the first section 13 and the inner wall face 14*w* of the second section 14 (see FIG. 7). Specifically, when the first section 13 and the second section 14 overlap each other such that the inner wall faces 13*w* and 14*w* face each other, the formation regions of the protruding faces 13S and 14S overlap each other. Accordingly, in a fixed state, the bag 30 is kept from being arranged in an unstable posture in which the bag 30 is distorted relative to the DW plane due to the holding member 11A. Therefore, in a packed state, a load imposed on the liquid container 20 from the packing member 10A is reduced.

In the first embodiment, the protruding faces 13S and 14S are configured to protrude by the same height, respectively in the inner wall faces 13*w* and 14*w*. Accordingly, the central position in the T direction of the bag 30 is kept from being arranged to be deviated from the central position sandwiched by the first section 13 and the second section 14 of the holding member 11A. Thus, the arrangement orientation of the bag 30 in the holding member 11A in a fixed state is further stabilized, and a load imposed on the liquid container 20 due to packing is reduced.

In the first embodiment, the pressurizing portion 17A is configured to press the bag 30, in a region positioned on the +D direction side relative to the center in the D direction of the liquid storage portion 30*c*, in a fixed state. Since the pressurizing portion 17A is configured to press a region separated from the liquid output port 52 in this manner, the load of pressing of the pressurizing portion 17A is kept from directly reaching the liquid output port 52. Therefore, deterioration such as deformation of the liquid output port 52 in a packed state is suppressed.

In addition, due to being pressurized by the pressurizing portion 17A in a fixed state, liquid is pressed to a region on the −D direction side of the liquid storage portion 30*c*, and thus liquid is kept from unevenly staying in a deep region on the +D direction side of the bag 30 far from the liquid output port 52. Therefore, when the liquid container 20 is removed from the packing member 10A, liquid is kept from coming into a state of staying unevenly in a region as described above, in the liquid container 20.

In the first embodiment, the spacer member 90 is arranged at a position substantially at the center in the D direction of the liquid storage portion 30*c* (see FIG. 7). It can also be said that the pressurizing portion 17A is formed so as to press the bag 30 in a region positioned on the +D direction side relative to the liquid outlet member 65, in a fixed state.

According to this configuration, a load is kept from being imposed on the liquid outlet member 65 due to the pressurizing portion 17A pressing the bag 30 in a fixed state. In addition, due to being pressurized by the pressurizing portion 17A, liquid in the liquid storage portion 30*c* is pressed toward the liquid outlet member 65, and the bag 30 is inflated in the periphery of the liquid outlet member 65. Thus, when the liquid container 20 that is packed in the packing member 10A receives an impact from the outside, an impact that is transmitted to the liquid outlet member 65 is mitigated. Thus, deterioration of the liquid outlet member 65 is suppressed.

In the first embodiment, the pressurizing portion 17A is configured to press the entire region in the W direction of the bag 30 in a region on the +D direction side relative to the center in the D direction of the liquid storage portion 30*c*, in a fixed state (see FIG. 7). According to this configuration, in a fixed state, the entire region in the W direction of the bag 30 is pressed, and thus the bag 30 is pressed against the holding member 11A, and movement of the bag 30 relative to/toward the holding member 11A is suppressed. Therefore, change in the orientation of the liquid container 20 when packed in the packing member 10A is suppressed, and even in the case where vibration is applied to the liquid container 20 for a long time, for example, when the liquid container 20 is carried, deterioration of the liquid container 20 is suppressed.

In the first embodiment, the pressurizing portion 17A is configured to press the bag 30, in the W direction, in regions of the liquid outlet member 65 that are positioned on two sides of the spacer member 90, in a fixed state (see FIG. 7). Accordingly, the pressurizing portion 17A is kept from pressing the liquid outlet member 65, and deterioration of the liquid outlet member 65 is suppressed. In addition, it is possible to increase the fixability of the liquid container 20 to the holding member 11A of the packing member 10A. In addition, in a fixed state, in the liquid storage portion 30*c*, a space in which movement in the W direction of the spacer member 90 is allowed is reduced. Therefore, deviation of the position of the spacer member 90 in a packed state is suppressed, and deterioration of the liquid outlet member 65 and the bag 30 due to movement of the spacer member 90 is suppressed.

In the first embodiment, the protruding faces 13S and 14S that respectively constitute the pressurizing portions 17A are configured as flat faces that occupy certain regions in the inner wall faces 13*w* and 14*w* (see FIG. 7). Accordingly, local distribution of stress in the bag 30 due to being pressurized by the pressurizing portion 17A is suppressed more than in a case where the protruding faces 13S and 14S are configured as sections having projections and recessions, and a case where the pressurizing portion 17A is configured by projections arranged in a dispersed manner. Thus, it is possible to reduce a load of the liquid container 20 imposed from the packing member 10A.

Figure 8:
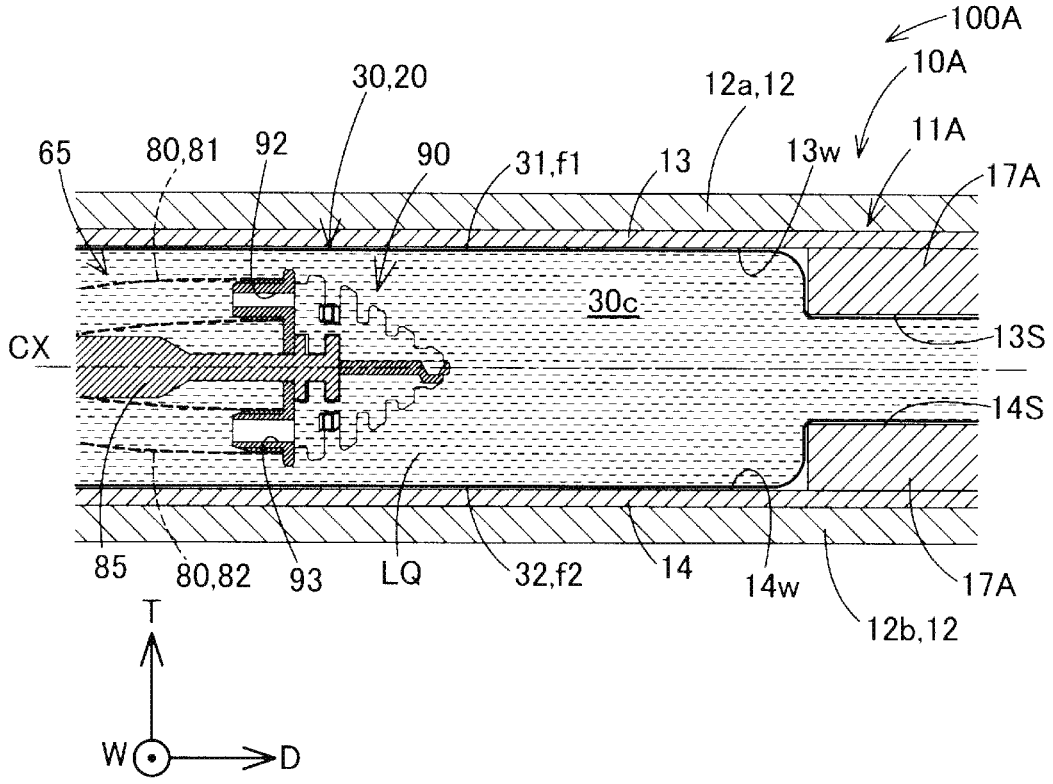
FIG. 8 is a schematic cross-sectional view showing an internal state of a liquid container in a fixed state.

FIG. 8 is a schematic cross-sectional view showing the inner state of the liquid container 20 in a fixed state in a package 100A. FIG. 8 illustrates a schematic cross-section of the packing member 10A and the liquid container 20 cut along a line 8-8 shown in FIG. 7. As a result of the liquid container 20 being packed in the packing member 10A, the package 100A is configured. Inside of the package 100A is in a fixed state in which the bag 30 of the liquid container 20 is fixed between the first section 13 and the second section 14 of the fixing portion 12.

In the first embodiment, the pressurizing portion 17A presses the bag 30, such that the height in the T direction of the liquid storage portion 30*c* is larger than the dimension in the T direction of the spacer member 90 at a position at which the spacer member 90 is arranged, due to pressure of the liquid LQ, in a fixed state. Therefore, in a state where the liquid container 20 is packed in the packing member 10A, the spacer member 90 is kept from coming into contact with the films f1 and f2 that constitute the bag 30, and damage and deterioration of the spacer member 90 and the bag 30 due to the contact is suppressed.

In particular, in the first embodiment, the spacer member 90 is supported by the liquid outlet tube 80 and the coupling member 85, and the spacer member 90 is configured to be separated from inner faces of the bag 30 and float in the liquid storage portion 30*c* in a fixed state. Therefore, in a state where the liquid container 20 is packed in the packing member 10A, contact between the spacer member 90 and the films f1 and f2 that constitute the bag 30 is further suppressed, and damage and deterioration of the spacer member 90 and the bag 30 are further suppressed.

Note that, in another embodiment, the spacer member 90 is not required to be configured to be separated from inner faces of the bag 30 and float in the liquid LQ in a fixed state, and may be configured to be arranged to be sunken in the bag 30. In addition, the spacer member 90 may be configured to float in the liquid LQ due to its own buoyancy.

Summary of First Embodiment

As described above, according to the packing member 10A of the first embodiment, the liquid container 20 is packed in a state where the pressure in the bag 30 is increased by the pressurizing portion 17A of the holding member 11A, and thus rippling of liquid in the bag 30 is suppressed. Therefore, in the liquid container 20 that is packed, deterioration of the bag 30 due to rippling of liquid, and deterioration of the liquid outlet member 65 contained in the bag 30 are suppressed. In addition, according to the package 100A of the first embodiment, for example, even if a load is imposed during transportation, conveyance, or the like, damage and deterioration of the liquid container 20 that is contained in the package 100A is suppressed as described above, and thus high durability against such a load is realized.

In addition, in the packing member 10A of the first embodiment, the first section 13 and the second section 14 of the holding member 11A are constituted by flat-plate-like members, and are not shaped like the outer shape of the liquid container 20. According to the packing member 10A of the first embodiment, with such a simple configuration, the liquid container 20 can be protected as described above. Therefore, the cost for packing the liquid container 20 can be reduced, and it is efficient. Other than that, according to the packing member 10A and the package 100A of the first embodiment, various actions and effects described in the first embodiment can be exerted.

2. Second Embodiment

Figure 9:
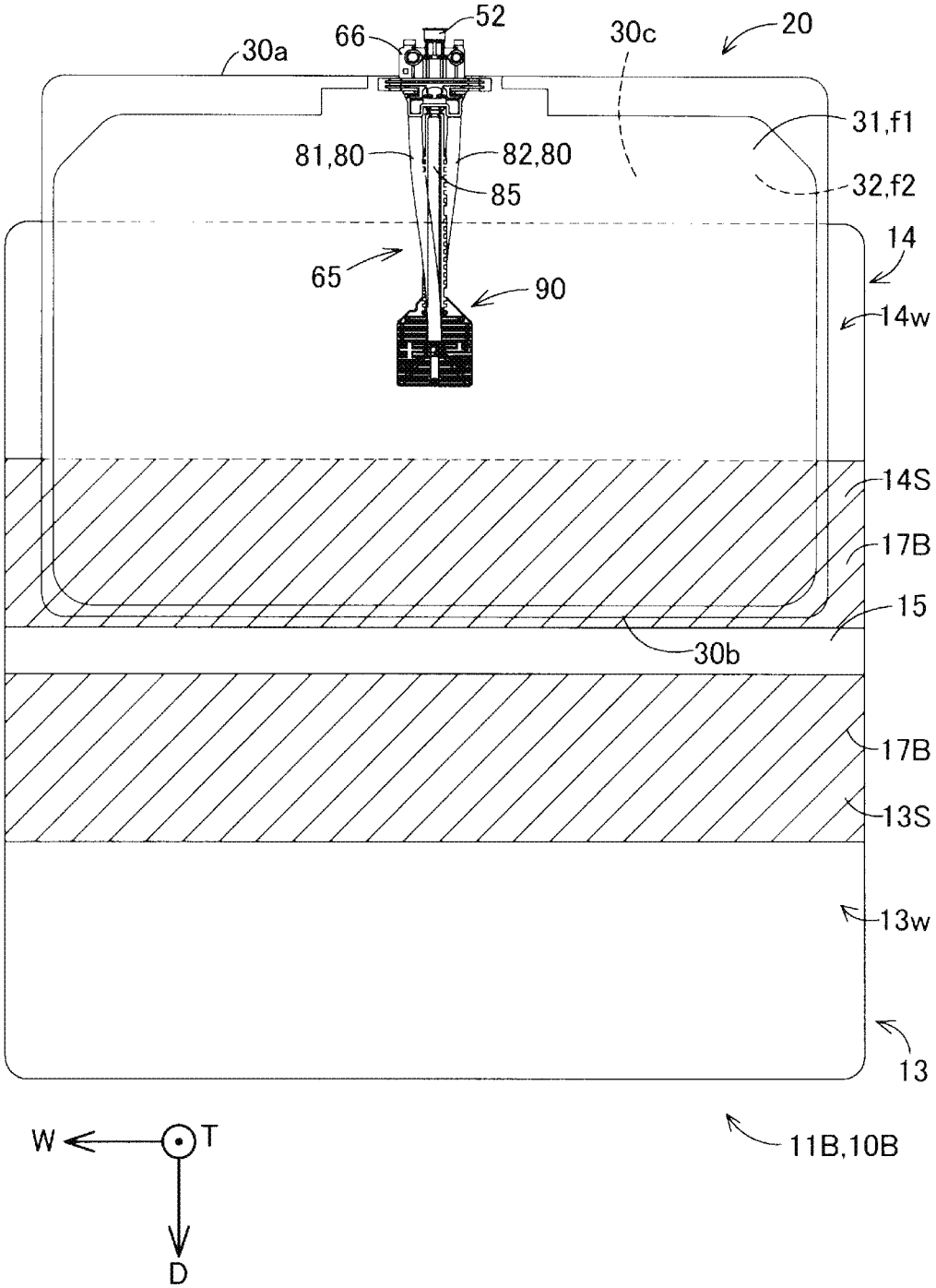
FIG. 9 is a schematic plan view showing the configuration of a pressurizing portion in a second embodiment.

FIG. 9 is a schematic plan view showing the configuration of a pressurizing portion 17B provided in a holding member 11B of a packing member 10B in a second embodiment.

FIG. 9 illustrates the holding member 11B of the second embodiment and a liquid container 20 when developed from a fixed state. In FIG. 9, a region in which the pressurizing portion 17B is formed is hatched. Note that, in FIG. 9, for convenience, the adapter 50 is not illustrated. In addition, the liquid outlet member 65 is illustrated to be visible through the bag 30 such that the position at which the liquid outlet member 65 is arranged can be perceived.

The packing member 10B of the second embodiment is substantially the same as the configuration of the packing member 10A of the first embodiment, except that the holding member 11B of the second embodiment is provided in place of the holding member 11A of the first embodiment, and the packing member 10B is used for packing the same liquid container 20 as described in the first embodiment. The configuration of the holding member 11B of the second embodiment is substantially the same as the configuration of the holding member 11A of the first embodiment, except that a region in which the pressurizing portion 17B is formed is different.

A region in which the pressurizing portion 17B of the second embodiment is formed is different from the region in which the pressurizing portion 17A of the first embodiment is formed, in that the pressurizing portion 17B is not configured to press regions positioned on the two sides of the spacer member 90 of the liquid outlet member 65 in the W direction, in a fixed state. The pressurizing portion 17B of the second embodiment is configured to press the entire region of the bag 30 in the W direction, in a region positioned on the +D direction side relative to the center in the D direction of the liquid storage portion 30*c*, in a fixed state. In addition, the pressurizing portion 17B is configured to press the entire region of the bag 30 in the W direction, in a region positioned on the +D direction side relative to the liquid outlet member 65.

Also with such a configuration, similar to the configuration descried in the first embodiment, a load of pressing of the pressurizing portion 17B is kept from directly reaching a liquid output port 52 and a liquid outlet member 65. Thus, in a packed state, deterioration of the liquid output port 52 and the liquid outlet member 65 is suppressed. Other than that, according to the packing member 10B of the second embodiment and a package in which the liquid container 20 is packed in the packing member 10B of the second embodiment, various actions and effects similar to those described in the above first embodiment can be exerted.

3. Third Embodiment

Figure 10:
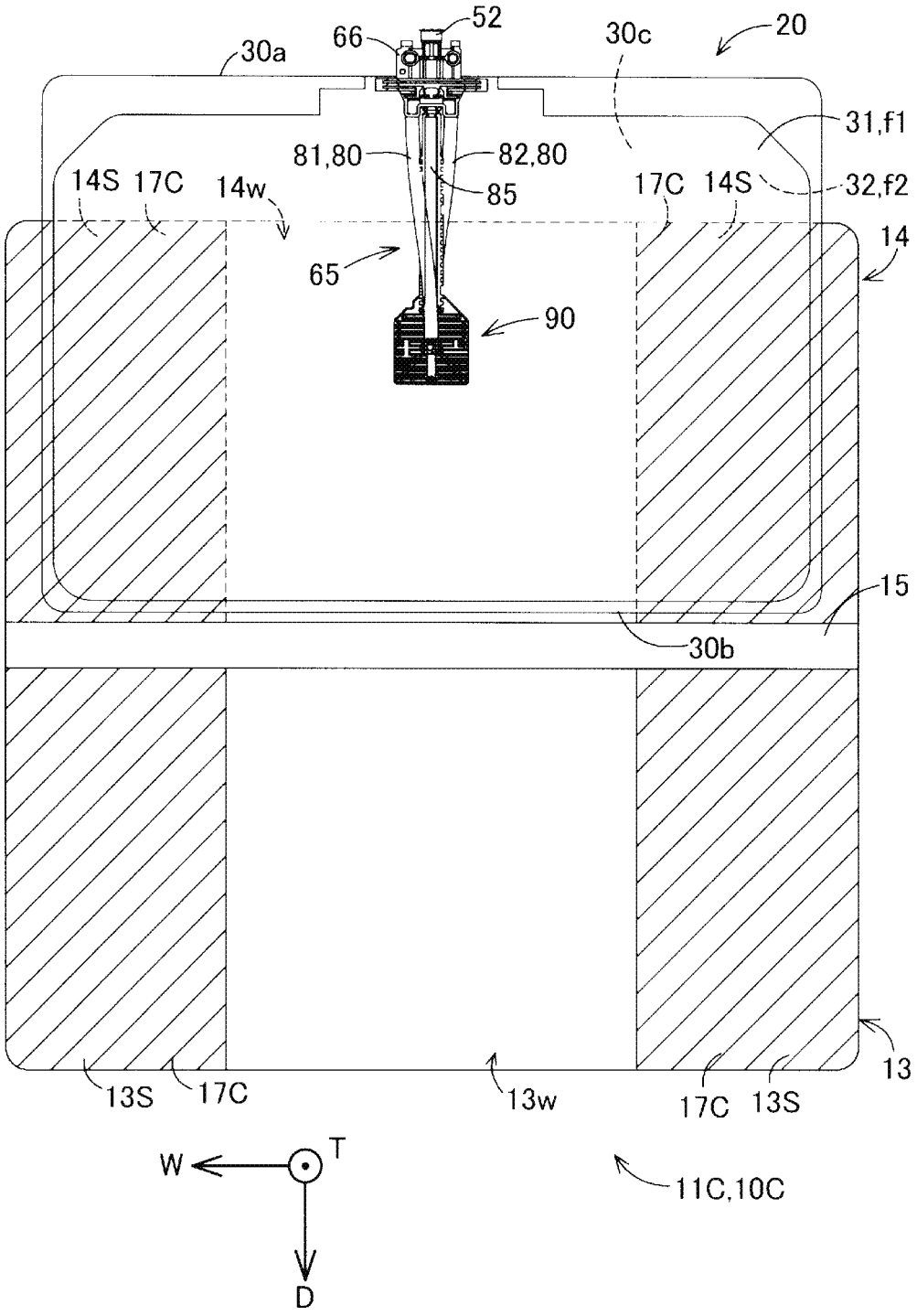
FIG. 10 is a schematic plan view showing the configuration of a pressurizing portion in a third embodiment.

FIG. 10 is a schematic plan view showing the configuration of a pressurizing portion 17C provided in a holding member 110 of a packing member 100 in a third embodiment. FIG. 10 illustrates the holding member 11C of the third embodiment and a liquid container 20 when developed from a fixed state. In FIG. 10, a region in which the pressurizing portion 17C is formed is hatched. Note that, in FIG. 10, for convenience, an adapter 50 is not illustrated. In addition, a liquid outlet member 65 is illustrated to be visible through a bag 30 such that the position at which the liquid outlet member 65 is arranged can be perceived.

The configuration of the packing member 100 of the third embodiment is substantially the same as the configuration of the packing member 10A of the first embodiment, except that the holding member 110 of the third embodiment is provided in place of the holding member 11A of the first embodiment, and the packing member 100 is used for packing the same liquid container 20 as described in the first embodiment. The configuration of the holding member 110 of the third embodiment is substantially the same as the configuration the holding member 11A of the first embodiment except that a region in which the pressurizing portion 17C is formed is different.

The pressurizing portion 17C of the third embodiment is configured to press the bag 30 in a region positioned on the +D direction side relative to the center in the D direction of a liquid storage portion 30*c*, in a fixed state. However, unlike the first embodiment, the pressurizing portion 17C does not have a section that presses the entire region in the W direction of the bag 30. The pressurizing portion 17C is configured to press the entire region in the D direction of the bag 30, a region on the +W direction side and a region on the −W direction side relative to the center in the W direction of the liquid storage portion 30*c*, in a fixed state.

According to the holding member 11C of the third embodiment, the entire region in the D direction of the bag 30 is pressed on the two sides, namely the +W direction side and the −W direction side, in a fixed state. Therefore, the arrangement angle in the W direction of the liquid container 20 is further fixed, and the orientation of the liquid container 20 in a packed state is further stabilized. Other than that, according to the packing member 10C of the third embodiment or a package in which the liquid container 20 is packed in the packing member 10C of the third embodiment, various actions and effects similar to those described in the above first embodiment can be exerted.

4. Fourth Embodiment

Figure 11:
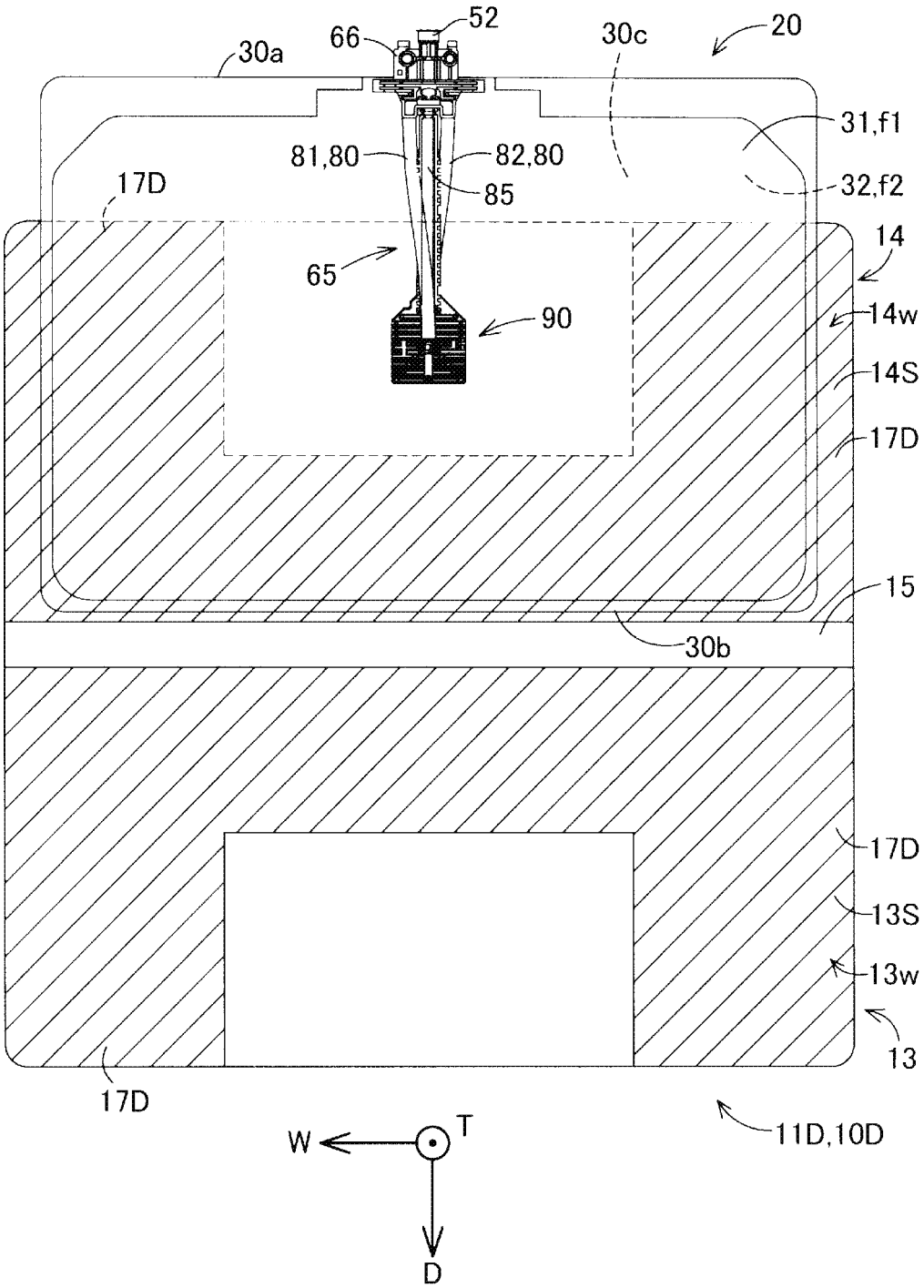
FIG. 11 is a schematic plan view showing the configuration of a pressurizing portion in a fourth embodiment.

FIG. 11 is a schematic plan view showing the configuration of a pressurizing portion 17D provided in a holding member 11D of a packing member 10D in a fourth embodiment. FIG. 11 illustrates the holding member 11C of the fourth embodiment and a liquid container 20 when developed from a fixed state. In FIG. 11, a region in which the pressurizing portion 17D is formed is hatched. Note that, in FIG. 11, for convenience, an adapter 50 is not illustrated. In addition, a liquid outlet member 65 is illustrated to be visible through a bag 30 such that the position at which the liquid outlet member 65 is arranged can be perceived.

The packing member 10D of the fourth embodiment is substantially the same as the configuration of the packing member 10A of the first embodiment except that the holding member 11D of the fourth embodiment is provided in place of the holding member 11A of the first embodiment, and the packing member 10D is used for packing the same liquid container 20 as described in the first embodiment. The configuration of the holding member 11D of the fourth embodiment is substantially the same as the configuration of the holding member 11A of the first embodiment, except that a region in which the pressurizing portion 17D is formed is different.

The pressurizing portion 17D of the fourth embodiment is configured to press the entire region in the D direction of the bag 30, in a region on the +W direction side and a region on the −W direction side relative to the center in the W direction in the liquid storage portion 30*c*, in a fixed state. In other respects, the configuration of the pressurizing portion 17D is substantially the same as the configuration of the pressurizing portion 17A of the first embodiment.

According to the holding member 11D of the fourth embodiment, it is possible to further fix the arrangement orientation of the liquid container 20, in a fixed state. Therefore, the orientation of the liquid container 20 in a packed state is stabilized more than the configuration of the first embodiment. Other than that, according to the packing member 10D of the fourth embodiment and a package in which the liquid container 20 is packed in the packing member 10D of the fourth embodiment, various actions and effects similar to those described in the above first embodiment can be exerted.

5. Fifth Embodiment

Figure 12:
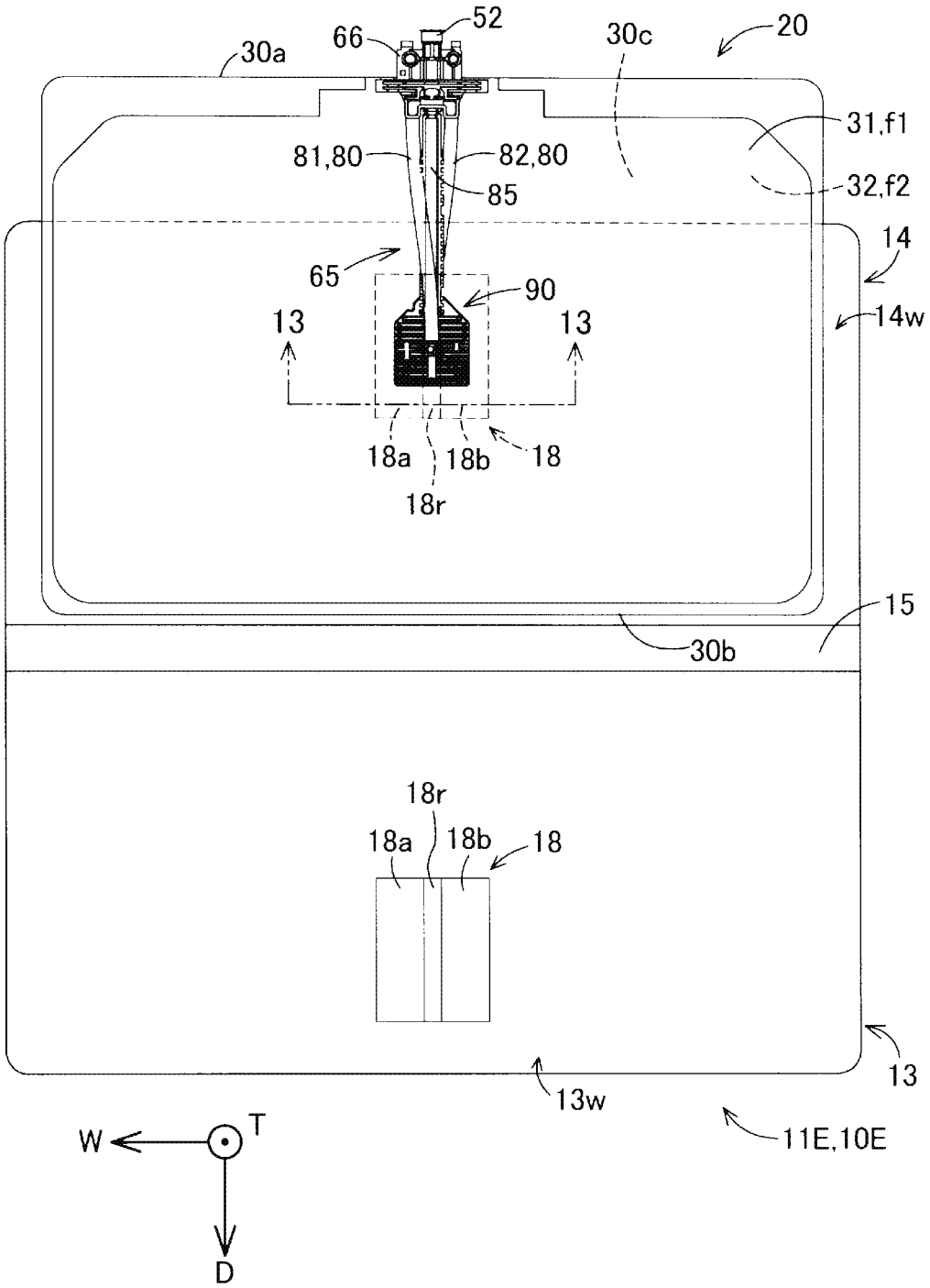
FIG. 12 is a schematic plan view showing the configuration of a packing member of a fifth embodiment.
Figure 13:
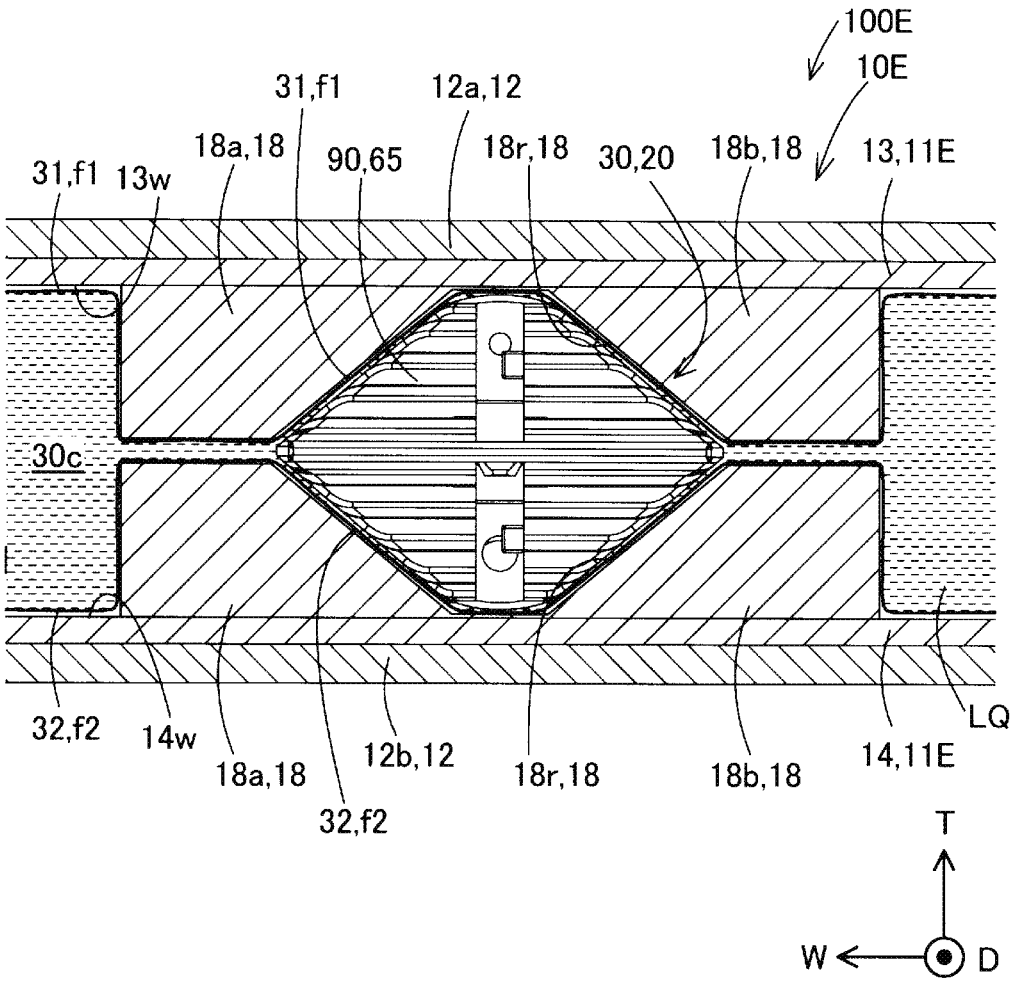
FIG. 13 is a schematic cross-sectional view showing an internal state of a liquid container in a fixed state.

The configuration of a holding member 11E provided in a packing member 10E in a fifth embodiment will be described with reference to FIGS. 12 and 13. FIG. 12 is a schematic plan view showing the configuration of a pressing portion 18 provided in the holding member 11E of the packing member 10E in the fourth embodiment. FIG. 12 illustrates the holding member 11E of the fifth embodiment and a liquid container 20 when developed from a fixed state. Note that, in FIG. 12, for convenience, an adapter 50 is not illustrated. In addition, a liquid outlet member 65 is illustrated to be visible through a bag 30 such that the position at which the liquid outlet member 65 is arranged can be perceived. FIG. 13 is a schematic cross-sectional view showing the internal state of the packing member 10E and the liquid container 20, in a fixed state in a package 100E of the fifth embodiment. FIG. 13 illustrates a schematic cross-section of the packing member 10E and the liquid container 20 cut along a line 13-13 shown in FIG. 12.

The packing member 10E of the fifth embodiment is substantially the same as the configuration of the packing member 10A of the first embodiment, except that the holding member 11E of the fifth embodiment is provided in place of the holding member 11A of the first embodiment, and the packing member 10E is used for packing the same liquid container 20 as described in the first embodiment. The configuration of the holding member 11E of the fifth embodiment is substantially the same as the configuration of the holding member 11A of the first embodiment, except that the pressing portion 18 is formed in place of the pressurizing portion 17A described in the first embodiment. As a result of the liquid container 20 being packed in the packing member 10E of the fifth embodiment, the package 100E of the fifth embodiment is configured. Inside of the package 100E is in a fixed state in which the bag 30 of the liquid container 20 is fixed between a first section 13 and a second section 14 of the holding member 11E.

In the holding member 11E of the fifth embodiment, the pressing portions 18 are respectively provided in the inner wall faces 13*w* and 14*w* of the first section 13 and the second section 14 (see FIG. 12). In a fixed state, the pressing portion 18 presses and supports at least a portion of the liquid outlet member 65 via the films f1 and f2 that constitute the bag 30, such that movement of the liquid outlet member 65 is suppressed in the liquid storage portion 30*c* (see FIG. 13). In the fifth embodiment, the pressing portion 18 is configured to press the spacer member 90, so as to suppress movement of the spacer member 90.

The pressing portions 18 are formed as projections provided to protrude toward the bag 30 in a fixed state, respectively in the inner wall faces 13*w* and 14*w* of the first section 13 and the second section 14. the pressing portion 18 is provided in a section in which the spacer member 90 is arranged, in a fixed state.

The pressing portion 18 has a first pressing portion 18*a* that presses the spacer member 90 from the +W direction side of the spacer member 90 toward the −W direction side, and a second pressing portion 18*b* that presses the spacer member 90 from the −W direction side of the spacer member 90 toward the +W direction side, in a fixed state. This makes it possible to more effectively suppress deviation of the position of the spacer member 90 in the W direction.

It is desirable that the pressing portion 18 is configured to have a recessed portion 18*r* having a shape that follows at least a portion of the outer periphery contour shape of the spacer member 90 when viewed in the D direction. Accordingly, change in the position of the spacer member 90 is further suppressed. In addition, the protection property of the spacer member 90 is improved.

According to the packing member 10E of the fifth embodiment, in a fixed state where the liquid container 20 and the holding member 11E are fixed by the fixing portion 12, deviation of the position of the spacer member 90 is suppressed in the liquid storage portion 30*c* by being pressed by the pressing portion 18. Thus, even if liquid ripples in the bag 30 in the liquid container 20 in a packed state, movement of the liquid outlet member 65 is suppressed in the bag 30. Therefore, the liquid outlet member 65 is kept from deviating in the bag 30 and being damaged and deteriorated.

In the packing member 10E of the fifth embodiment and the package 100E of the fifth embodiment, the first section 13 and the second section 14 of the holding member 11A are constituted by flat-plate-like members, and are not shaped like the outer shape of the liquid container 20. According to the packing member 10E of the fifth embodiment, even in such a simple configuration, the liquid container 20 can be protected as described above. Therefore, cost for packing the liquid container 20 can be reduced, and it is efficient. Other than that, according to the packing member 10E of the fifth embodiment and the package 100E of the fifth embodiment, by providing a configuration in common with the packing member 10A of the first embodiment and the package 100A, various actions and effects described in the first embodiment can be exerted.

6. Other Embodiments

Various configurations described in the above embodiments can be modified as follows, for example. Embodiments to be described below are all regarded as an example of a mode for implementing the present invention, similar to the above embodiments and the configuration described as other embodiments in the above embodiments.

6-1. Other Embodiment 1

The bag 30 of the liquid container 20 may have the configuration of a gusset type bag. The bag 30 may have a face intersecting the first face 31 and the second face 32 in addition to the first face 31 and the second face 32. The first face 31 and the second face 32 of the bag 30 are not required to have a substantially rectangular shape in which the W direction is defined as a long-side direction. For example, the first face 31 and the second face 32 may have a substantially rectangular shape in which the W direction is defined as a short-side direction, or may have a substantially circular shape.

6-2. Other Embodiment 2

In the above embodiments, the adapter 50 and the handle portion 62 may be omitted. In addition, in the above first, second, third, and fourth embodiments, the liquid outlet member 65 may be omitted. In this case, a configuration may be adopted in which an opening that constitutes the liquid output port 52 is only provided on the one edge 30*a* of the bag 30.

6-3. Other Embodiment 3

In the above embodiments, the first section 13 and the second section 14 of the holding members 11A to 11E are not required to have flat plate-like outer shapes. For example, a configuration may be adopted in which the first section 13 and the second section 14 are shaped like the outer shape of the liquid container 20, and have a recessed portion into which the liquid container 20 are fitted. The first section 13 and the second section 14 are not required to have a substantially rectangular shape when viewed in the thickness direction, and may have a circular shape, for example. The first section 13 and the second section 14 may be configured to cover the entire bag 30, or may be configured to cover the entire liquid container 20.

6-4. Other Embodiment 4

In the above embodiments, the coupling portion 15 may be made of a material different from the material of the first section 13 or the second section 14. The coupling portion 15 may be made of a tape stretched across the first section 13 and the second section 14 to bridge over the first section 13 and the second section 14, for example. The coupling portion 15 may be omitted.

6-5. Other Embodiment 5

In the above embodiments, the fixing portion 12 is not required to be constituted by an outer box. For example, the fixing portion 12 may be configured by a band-like or string-like fastening member that fixes the first section 13 and the second section 14 that sandwich the bag 30, by being wound around and fastening the first section 13 and the second section 14. The fixing portion 12 may be constituted by a film member that wraps the liquid container 20 and the holding members 11A to 11E. The fixing portion 12 may be constituted by a tape stretched between the first section 13 and the second section 14 that sandwich the bag 30.

6-6. Other Embodiment 6

In the above first, second, third, and fourth embodiments, the pressurizing portions 17A to 17D may be configured to press the bag 30, in a region positioned on the +D direction side relative to the center in the D direction of the liquid storage portion 30*c*, in a fixed state.

6-7. Other Embodiment 7

In the above first, second, third, and fourth embodiments, the pressurizing portions 17A to 17D may be provided in at least one of the first section 13 and the second section 14. One of the protruding faces 13S and 14S that constitute the pressurizing portions 17A to 17D may be omitted. The protruding faces 13S and 14S that constitute the pressurizing portions 17A to 17D may be configured to press different regions.

6-8. Other Embodiment 8

In the above first, second, third, and fourth embodiments, the pressurizing portions 17A to 17D are not required to be constituted by the protruding faces 13S and 14S that protrude further on the bag 30 side than other sections, in a fixed state. For example, a configuration may be adopted in which the entirety of faces of the first section 13 and the second section 14 that face the bag 30 are configured to have a shape bending toward the bag 30, and thereby the pressurizing portions 17A to 17D press a portion of the bag 30. For example, a configuration may be adopted in which the first section 13 and the second section 14 are constituted by different members, and the pressurizing portions 17A to 17D are constituted by a structure arranged between the bag 30 and at least one of the first section 13 and the second section 14.

6-9. Other Embodiment 9

In the above fifth embodiment, the liquid outlet member 65 is not required to have the spacer member 90. In this case, the pressing portion 18 may be configured to press a section in the liquid outlet member 65 excluding the spacer member 90, so as to suppress movement of the liquid outlet member 65 in the liquid storage portion 30*c*.

6-10. Other Embodiment 10

In the above fifth embodiment, the pressing portion 18 may be provided only at least one of the first section 13 and the second section 14. A plurality of pressing portion 18 may be provided in at least one of the first section 13 and the second section 14. In addition, the pressing portion 18 may be configured to press different sections of the liquid outlet member 65, between the first section 13 and the second section 14. A configuration may be adopted in which, for example, the first section 13 and the second section 14 are constituted by different members, the pressing portion 18 is constituted by a structure arranged between the bag 30 and at least one of the first section 13 and the second section 14.

6-11. Other Embodiment 11

An object to be packed in the packing members 10A to 10E is not limited to a liquid container in which liquid to be supplied to a liquid ejection apparatus is contained. The packing members 10A to 10E may be configured to be used for packing a liquid container in which various types of liquid other than ink is contained. "Liquid" need only to be a material whose substance is in the liquid phase, and includes fluids such as an inorganic solvent, an organic solvent, a solution, a liquid resin, and a liquid metal (metal melt) in the form of a material in the state of liquid having a high or low viscosity, a sol, gel water, or the like. In addition, the "liquid" is not limited to being a one-state substance, and also includes particles of a functional material made from solid matter, such as pigment or metal particles, that are dissolved, dispersed, or mixed in a solvent.

The invention is not limited to the above embodiments and modified example and can be achieved as various configurations without departing from the gist of the present invention. For example, the technical features in the embodiments and the modified example that correspond to the technical features in the modes described in the summary of the present invention may be replaced or combined as appropriate in order to solve a part of, or the entire foregoing problem, or to achieve some or all of the above-described effects. In addition, the technical features that are not described as essential in the specification may be deleted as appropriate.

What is claimed is:

1. A packing member for packing a liquid container including a flexible bag having a first face and a second face arranged to sandwich a liquid storage portion in a T direction, and a liquid output port provided on one edge of the bag and having a central axis that runs along a D direction, wherein three directions orthogonal to each other are defined as the T direction, the D direction, and a W direction, the packing member comprising:

a first section arranged to face the first face along a DW plane that includes the D direction and the W direction;

a second section arranged to face the second face along the DW plane, and sandwiches the bag in the T direction in cooperation with the first section;

a fixing portion that fixes the first section and the second section in a state of sandwiching the bag in the T direction; and a pressurizing portion that presses a region of a portion of the bag sandwiched between the first section and the second section such that, in a fixed state where the bag is fixed between the first section and the second section by the fixing portion, pressure in the liquid storage portion becomes higher than pressure before the fixed state is entered.

2. The packing member according to claim 1, wherein, when, from among directions along the D direction, a direction from the liquid output port toward the liquid storage portion is defined as a +D direction, and a direction opposite to the +D direction is defined as a −D direction, the pressurizing portion presses the bag, in the fixed state, in a region positioned on the +D direction side relative to a center in the D direction of the liquid storage portion.

3. The packing member according to claim 2, wherein, in the fixed state, the pressurizing portion is configured to press an entire region in the W direction of the bag, in a region on the +D direction side relative to a center in the D direction of the liquid storage portion.

4. The packing member according to claim 2, wherein, when one of directions along the W direction is defined as a +W direction, and the other direction is defined as a −W direction, the pressurizing portion is configured to press an entire region in the D direction of the bag, in a region on the +W direction side relative to a center in the W direction in the liquid storage portion, and a region on the −W direction side relative to the center in the W direction of the liquid storage portion, in the fixed state.

5. The packing member according to claim 2, wherein the liquid container further includes a liquid outlet member that has the liquid output port, extends along the D direction in the liquid storage portion, and guides the liquid that is led out from the liquid output port, and in the fixed state, the pressurizing portion presses the bag in a region positioned on the +D direction side relative to the liquid outlet member.

6. The packing member according to claim 5, wherein the pressurizing portion further presses the bag in regions positioned on two sides of the liquid outlet member in the W direction, in the fixed state.

7. The packing member according to claim 5, wherein the liquid outlet member includes a spacer member that is provided in an end portion on the +D direction side, whose dimension in the T direction is largest in the liquid outlet member, and that suppresses collapse in the T direction of the liquid storage portion; and the pressurizing portion presses the bag such that, in the fixed state, a height in the T direction of the liquid storage portion at a position at which the spacer member is arranged is larger than a dimension in the T direction of the spacer member due to pressure of the liquid.

8. The packing member according to claim 7, wherein, in the fixed state, the spacer member floats in the liquid in the liquid storage portion, and is arranged in a state of being separated from an inner face of the bag.

9. The packing member according to claim 1, wherein the first section and the second section have flat-plate-like outer shapes, and the pressurizing portion is constituted by a face that is provided in at least one of the first section and the second section, and protrudes on the bag side relative to another section in the fixed state.

10. A packing member for packing a liquid container including a flexible bag having a first face and a second face arranged to sandwich a liquid storage portion in a T direction, and a liquid outlet member having a liquid output port provided on one edge of the bag and extending along the D direction in the liquid storage portion, wherein three directions orthogonal to each other are defined as the T direction, the D direction, and a W direction, the packing member comprising:

a first section that is arranged to face the first face along a DW plane that includes the D direction and the W direction;

a second section arranged to face the second face along the DW plane, and sandwiches the bag in the T direction in cooperation with the first section;

a fixing portion that fixes the first section and the second section in a state of sandwiching the bag in the T direction; and a pressing portion that presses at least a portion of the liquid outlet member via the bag in the T direction in a fixed state where the bag is fixed between the first section and the second section by the fixing portion, and suppresses movement of the liquid outlet member in the liquid storage portion.

11. A package comprising:

a liquid container including a flexible bag having a first face and a second face arranged to sandwich a liquid storage portion in a T direction, and a liquid output port provided on one edge of the bag and having a central axis that runs along a D direction, wherein three directions orthogonal to each other are defined as the T direction, the D direction, and a W direction; and the packing member that packs the liquid container according to claim 1.

12. A package comprising:

a liquid container including a flexible bag having a first face and a second face arranged to sandwich a liquid storage portion in a T direction, and a liquid output port provided on one edge of the bag and having a central axis that runs along a D direction, wherein three directions orthogonal to each other are defined as the T direction, the D direction, and a W direction; and the packing member that packs the liquid container according to claim 2.

13. A package comprising:

a liquid container including a flexible bag having a first face and a second face arranged to sandwich a liquid storage portion in a T direction, and a liquid output port provided on one edge of the bag and having a central axis that runs along a D direction, wherein three directions orthogonal to each other are defined as the T direction, the D direction, and a W direction; and the packing member that packs the liquid container according to claim 3.

14. A package comprising:

a liquid container including a flexible bag having a first face and a second face arranged to sandwich a liquid storage portion in a T direction, and a liquid output port provided on one edge of the bag and having a central axis that runs along a D direction, wherein three directions orthogonal to each other are defined as the T direction, the D direction, and a W direction; and the packing member that packs the liquid container according to claim 4.

15. A package comprising:

a liquid container including a flexible bag having a first face and a second face arranged to sandwich a liquid storage portion in a T direction, and a liquid output port provided on one edge of the bag and having a central axis that runs along a D direction, wherein three directions orthogonal to each other are defined as the T direction, the D direction, and a W direction; and the packing member that packs the liquid container according to claim 5.

16. A package comprising:

a liquid container including a flexible bag having a first face and a second face arranged to sandwich a liquid storage portion in a T direction, and a liquid output port provided on one edge of the bag and having a central axis that runs along a D direction, wherein three directions orthogonal to each other are defined as the T direction, the D direction, and a W direction; and the packing member that packs the liquid container according to claim 6.

17. A package comprising:

a liquid container including a flexible bag having a first face and a second face arranged to sandwich a liquid storage portion in a T direction, and a liquid output port provided on one edge of the bag and having a central axis that runs along a D direction, wherein three directions orthogonal to each other are defined as the T direction, the D direction, and a W direction; and the packing member that packs the liquid container according to claim 7.

18. A package comprising:

a liquid container including a flexible bag having a first face and a second face arranged to sandwich a liquid storage portion in a T direction, and a liquid output port provided on one edge of the bag and having a central axis that runs along a D direction, wherein three directions orthogonal to each other are defined as the T direction, the D direction, and a W direction; and the packing member that packs the liquid container according to claim 8.

19. A package comprising:

a liquid container including a flexible bag having a first face and a second face arranged to sandwich a liquid storage portion in a T direction, and a liquid output port provided on one edge of the bag and having a central axis that runs along a D direction, wherein three directions orthogonal to each other are defined as the T direction, the D direction, and a W direction; and the packing member that packs the liquid container according to claim 9.

20. A package comprising:

a liquid container including a flexible bag having a first face and a second face arranged to sandwich a liquid storage portion in a T direction, and a liquid outlet member having a liquid output port provided on one edge of the bag and extending along the D direction in the liquid storage portion, wherein three directions orthogonal to each other are defined as the T direction, the D direction, and a W direction; and the packing member that packs the liquid container according to claim 10.

* * * * *